US008642237B2

(12) United States Patent
Tani et al.

(10) Patent No.: US 8,642,237 B2
(45) Date of Patent: Feb. 4, 2014

(54) TONER

(75) Inventors: Atsushi Tani, Suntou-gun (JP); Tetsuya Kinumatsu, Numazu (JP); Ayako Okamoto, Susono (JP); Kenji Aoki, Mishima (JP); Shuntaro Watanabe, Hadano (JP); Takaaki Kaya, Suntou-gun (JP); Takashige Kasuya, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 13/187,009

(22) Filed: Jul. 20, 2011

(65) Prior Publication Data

US 2012/0021349 A1 Jan. 26, 2012

(30) Foreign Application Priority Data

Jul. 22, 2010 (JP) ..... 2010-165306

(51) Int. Cl.
*G03G 9/087* (2006.01)

(52) U.S. Cl.
USPC ..... 430/109.4; 430/111.4

(58) Field of Classification Search
USPC ..... 430/96–110.4
See application file for complete search history.

(56) References Cited

U.S. PATENT DOCUMENTS

| | | | | |
|---|---|---|---|---|
| 2004/0009420 | A1 | 1/2004 | Sugahara et al. | |
| 2004/0137354 | A1 | 7/2004 | Yamazaki et al. | |
| 2004/0152006 | A1 | 8/2004 | Teshima | |
| 2007/0026335 | A1 | 2/2007 | Yamamoto et al. | |
| 2010/0124715 | A1 * | 5/2010 | Nakazawa et al. | 430/109.4 |
| 2011/0065039 | A1 * | 3/2011 | Ota et al. | 430/109.3 |

FOREIGN PATENT DOCUMENTS

| | | | |
|---|---|---|---|
| EP | 254543 | A2 | 1/1988 |
| JP | 2001-013727 | A | 1/2001 |
| JP | 2002-318471 | A | 10/2002 |
| JP | 2003-084485 | A | 3/2003 |
| JP | 2004-191927 | A | 7/2004 |
| JP | 2004-354811 | A | 12/2004 |
| JP | 2005-234046 | A | 9/2005 |
| JP | 2006-084843 | A | 3/2006 |
| JP | 2006-091318 | A | 4/2006 |
| JP | 2006-276074 | A | 10/2006 |
| JP | 2007-065638 | A | 3/2007 |

* cited by examiner

*Primary Examiner* — Christopher Rodee

*Assistant Examiner* — Omar Kekia

(74) *Attorney, Agent, or Firm* — Canon USA, Inc. IP Division

(57) ABSTRACT

In differential scanning calorimetry of a toner, regarding a binder resin in the toner, (i) the peak temperature T10 of a maximum endothermic peak (temperature raising rate 10.0° C./min; P10) is 50° C. to 80° C. and the half-width W10 is 2.0° C. to 3.5° C. and (ii) W1, W10, and W20 satisfy that W1/W10 is 0.20 to 1.00 and W20/W10 is 1.00 to 1.50, where the half-width of a maximum endothermic peak (temperature raising rate of 1.0° C./min; P1) is represented by W1 (° C.) and the half-width of a maximum endothermic peak (temperature raising rate of 20.0° C./min; P20) is represented by W20 (° C.).

4 Claims, 3 Drawing Sheets

TONER

BACKGROUND OF THE INVENTION

1. Field of the Invention

The present invention relates to a toner used for electrophotography, an electrostatic recording method, and a toner jet system recording method.

2. Description of the Related Art

In recent years, regarding an electrophotographic apparatus, it is considered that energy conservation is a large technical issue, and significant reduction in amount of heat required for a fixing apparatus has been studied. Consequently, regarding a toner, needs for so-called "low-temperature fixability" referring to that fixing can be effected at lower energy has grown.

As for the technique to make low temperature fixing possible, lowering of the glass transition temperature (Tg) of a binder resin in a toner is mentioned. However, lowering of Tg leads to degradation in thermal storage resistance of the toner. Therefore, it is usually difficult for this technique to ensure the compatibility between the low-temperature fixability and the thermal storage resistance of the toner.

In order to ensure the compatibility between the low-temperature fixability and the thermal storage resistance of the toner, a method in which a crystalline polyester is used as the binder resin has been studied.

In general, an amorphous resin used as the binder resin for the toner does not exhibit an endothermic peak in a measurement with a differential scanning calorimeter (DSC). However, in the case where a crystalline resin is contained in the binder resin, an endothermic peak appears in the DSC measurement. The peak temperature of this endothermic peak refers to the melting point of the crystalline resin.

The above-described crystalline polyester is a resin having a crystalline structure, does not have a clear Tg, and has a property of hardly softening at a temperature lower than the melting point. The melting point is the threshold of rapid melting accompanying sharp reduction in viscosity. Therefore, the crystalline polyester has been noted as a material having an excellent sharp melt property and ensuring the compatibility between the low-temperature fixability and the thermal storage resistance.

Japanese Patent Laid-Open No. 2002-318471 proposes a toner, wherein a crystalline polyester resin having a melting point of 80° C. or higher, and 140° C. or lower is used as a binder resin. However, regarding this technology, there is a problem in that fixing in a lower temperature range is not achieved because the crystalline polyester having a high melting point is used.

In order to solve the above-described issue, a technology has been proposed, in which a crystalline polyester having a lower melting point is used and a binder resin containing an amorphous substance is used (refer to Japanese Patent Laid-Open No. 2006-276074, for example). In the technology disclosed in Japanese Patent Laid-Open No. 2006-276074, a mixture of a crystalline polyester and a cycloolefin based copolymer resin is used as the binder resin. However, regarding this technology, the proportion of the amorphous substance is large, the fixability also depends on Tg of the amorphous substance and, thereby, there is a problem in that the sharp melt property of the crystalline polyester is not utilized sufficiently.

Then, technologies have been proposed, in which a crystalline polyester is contained as a primary component in a binder resin and it is aimed to make full use of the sharp melt property thereof (refer to Japanese Patent Laid-Open No. 2004-191927, Japanese Patent Laid-Open No. 2005-234046, and Japanese Patent Laid-Open No. 2006-084843, for example). However, according to the studies of the present inventors on the basis of the above-described disclosures, it was made clear that the melting point peak of the crystalline polyester in the toner became broad, and the sharp melt property of the crystalline polyester was not able to be utilized effectively. The reason therefor is believed to be that in the above-described technology, a toner was produced through a heating step at a temperature higher than or equal to the melting point of the crystalline polyester and, thereby, the crystallinity was degraded.

As described above, the compatibility between the low-temperature fixability and the thermal storage resistance of the toner still has a problem.

SUMMARY OF THE INVENTION

The present invention provides a toner.

That is, the present invention provides a toner exhibiting excellent low-temperature fixability and excellent thermal storage resistance in combination and being capable of keeping these performances stably over long-term storage.

The present invention relates to a toner comprising toner particles each of which comprises a binder resin, a colorant and wax, wherein the binder resin comprises a resin (a) having 50 percent by mass or more of polyester unit, and wherein, in the measurement of the endothermic amount of the toner by using a differential scanning calorimeter, (1) regarding the endothermic amount derived from the binder resin in the measurement at a temperature raising rate of 10.0° C./min, the peak temperature (T10) of a maximum endothermic peak (P10) is 50° C. or higher, and 80° C. or lower and the half-width (W10) of the maximum endothermic peak (P10) is 2.0° C. or more, and 3.5° C. or less, and (2) W1, W10, and W20 satisfy the following formulae (1) and (2), $$0.20 \leq (W1/W10) \leq 1.00 \quad (1)$$

$$1.00 \leq (W20/W10) \leq 1.50 \quad (2)$$

where W1 (° C.) represents the half-width of a maximum endothermic peak (P1) regarding the endothermic amount derived from the binder resin in the measurement at a temperature raising rate of 1.0° C./min, and W20 (° C.) represents the half-width of a maximum endothermic peak (P20) regarding the endothermic amount derived from the binder resin in the measurement at a temperature raising rate of 20.0° C./min.

According to the present invention, a toner exhibiting excellent low-temperature fixability and excellent thermal storage resistance in combination and being capable of keeping these performances stably over long-term storage can be provided.

Further features of the present invention will become apparent from the following description of exemplary embodiments with reference to the attached drawings.

DESCRIPTION OF THE EMBODIMENTS

Figure 1:
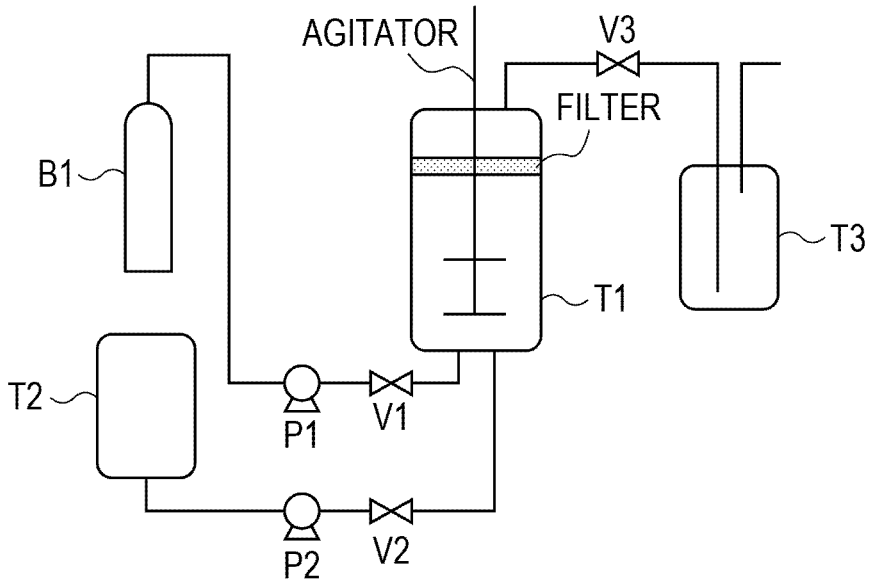
FIG. 1 is a schematic diagram showing the configuration of a manufacturing apparatus of a toner according to the present invention.

The toner according to the present invention includes a binder resin containing a resin (a) having 50 percent by mass or more of polyester unit. The resin (a) is a resin exhibiting crystallinity.

The resin exhibiting crystallinity refers to a resin forming on a structure in which polymer molecular chains are arranged regularly. Such a resin exhibits a clear melting point peak when the endothermic amount is measured with a differential scanning calorimeter (DSC).

Regarding the endothermic amount derived from the binder resin of the toner determined on the basis of the measurement of the endothermic amount of the toner with the differential scanning calorimeter (DSC) under the condition of a temperature raising rate of 10.0° C./min, the peak temperature T10 of a maximum endothermic peak (P10) is 50° C. or higher, and 80° C. or lower.

The above-described maximum endothermic peak (P10) is derived from the resin (a) which is a crystalline resin containing a polyester unit as a primary component. This crystalline resin can be a crystalline polyester. That is, the toner according to the present invention can contain a crystalline polyester component having a melting point of 50° C. or higher, and 80° C. or lower.

As described above, the crystalline polyester has a crystalline structure in which polymer molecular chains are arranged regularly and, therefore, is a resin having an excellent sharp melt property and being capable of realizing the compatibility between the low-temperature fixability and the thermal storage resistance.

It is advantageous for the low-temperature fixability that the peak temperature T10 of the above-described maximum endothermic peak (P10) is lower than 50° C., but the thermal storage resistance of the toner is degraded significantly. The peak temperature T10 is more preferably 55° C. or higher. If the peak temperature T10 is higher than 80° C., excellent thermal storage resistance is exhibited, but it becomes difficult to achieve sufficient low-temperature fixability. The peak temperature T10 is more preferably 70° C. or lower.

In the present invention, the value of the peak temperature T10 of the above-described maximum endothermic peak (P10) can be adjusted by selecting the types and the combination of monomers used for production of the crystalline polyester component appropriately.

However, even such a crystalline polyester has characteristics as a polymer and, therefore, not always take a completely regular structure. Low melting point components having small molecular weights may be contained, and some extent of temperature width appears in the endothermic peak on the basis of the DSC measurement.

Furthermore, in the case where the crystalline polyester resin is used as a toner material, in a production process, steps to dissolve into an organic solvent together with other materials and give a heat history higher than or equal to the melting point are required. Therefore, it is not easy to allow the crystalline polyester to present in the toner while keeping intrinsic crystallinity.

Regarding the above-described toner including low molecular weight components and low crystallinity components, these components cause degradation in thermal storage resistance even when a crystalline polyester resin having an appropriate melting point is used in the toner.

In the case where the toner is stood for a long term, the crystallinity may be further degraded by influences of these components, and changes may occur in thermal properties of the toner, so as to cause degradation in low-temperature fixability and thermal storage resistance.

Therefore, in order to wield the crystalline polyester resin as a toner material, it is very important to optimize the crystallinity in addition to optimize the melting point and the content, as a matter of course.

In order to obtain a toner containing a high crystallinity binder resin, in production of toner particles, a method in which application of thermal history is minimized can be selected, although the crystallinity can also be controlled after the production of the toner particles. Specifically, a heat treatment is performed at a temperature lower than the melting point of the above-described crystalline polyester component. In the present invention, hereafter this heat treatment is referred to as an "annealing treatment".

In general, it is known that the crystallinity of the crystalline resin is enhanced by application of the annealing treatment. The principle thereof is believed to be as described below. That is, when a crystalline material is subjected to the annealing treatment, molecular mobility of polymer chains is increased by the heat thereof to some extent and, thereby, the polymer chains are reoriented to a more stable structure, that is, a regular crystalline structure, so that crystallization occurs. In the case where the treatment is performed at a temperature higher than or equal to the melting point of the crystalline material, the polymer chains obtain energy higher than the energy required for reorientation and, therefore, recrystallization does not occur.

Therefore, it is important that the annealing treatment in the present invention is performed in a limited temperature range relative to the melting point of the crystalline polyester component in order to maximize activation of the molecular motion of the crystalline polyester component in the toner.

The present inventors noted the shape of a maximum peak of the endothermic amount derived from a crystalline polyester regarding a toner containing relatively large amounts of crystalline polyester component in a binder resin. The half-width of the above-described maximum endothermic peak can be utilized as an index roughly indicating the crystal state of the crystalline polyester component contained in the toner. That is, a smaller half-width refers to a higher crystallinity.

The present inventors examined changes in half-width of the maximum endothermic peak in detail, where the DSC measurement was performed while the temperature raising rate was changed.

As a result, it was made clear that regarding even toners having relatively sharp endothermic peaks, there is a large difference in manner of fluctuation of the half-width relative to changes in temperature raising rate between toners capable of keeping the above-described performance over a long term and toners incapable of keeping that. Then, it was found that the above-described dependence of the half-width on the temperature raising rate resulted from a difference in the crystallinity of the crystalline polyester component, and the present invention has been completed.

Figure 2:
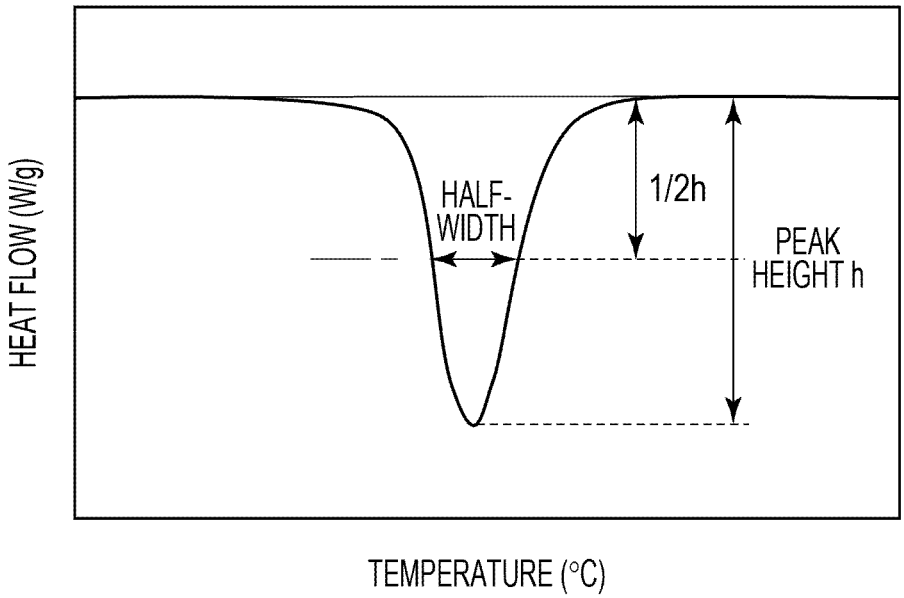
FIG. 2 is a schematic diagram for explaining the half-width of an endothermic peak on the basis of a DSC measurement of a toner.

FIG. 2 schematically shows an endothermic peak obtained by the DSC measurement of the toner according to the present invention. In this example, the endothermic peak derived from a binder resin and the endothermic peak derived from wax do not overlap with each other and, therefore, the maximum endothermic peak of the toner can be considered as-is to be the endothermic peak derived from the binder resin.

Regarding the toner according to the present invention, the range of the half-width W10 of the maximum endothermic peak (P10) on the basis of the DSC measurement under the condition of a temperature raising rate of 10.0° C./min is preferably 2.0° C. or more, and 3.5° C. or less.

A toner having the above-described half-width W10 exceeding 3.5° C. includes a low crystallinity part of the crystalline polyester component. The crystal state of such a toner may changes during long-term storage, so that degradation in low-temperature fixability and thermal storage resistance may be brought about.

Meanwhile, the toner having a half-width W10 smaller than 2.0° C. is obtained in the case where the above-described annealing treatment is performed excessively (for example, the treatment is performed at a higher temperature). Regarding such a toner, degradation in thermal storage resistance, which may result from the excessive annealing treatment, may be brought about. It is believed that this occurs because of recrystallization of polymer chains, which have relatively low molecular weights and which are softened by excess heat, as a low melting point component without being rearranged.

That is, a toner capable of keeping excellent low-temperature fixability and thermal storage resistance over a long term stably can be obtained by controlling the above-described half-width W10 in the range of 2.0° C. or more, and 3.5° C. or less.

Regarding the toner according to the present invention, in the differential scanning calorimeter (DSC) measurement, W1 and W10 satisfy the following formula (1), $$0.20 \leq (W1/W10) \leq 1.00 \quad (1)$$

where the half-width of a maximum endothermic peak (P1) is represented by W1 (° C.) regarding the endothermic amount derived from the binder resin in the toner in the measurement under the condition of a temperature raising rate of 1.0° C./min.

It is believed that the endothermic behavior when the temperature raising in the DSC measurement is performed at a low rate reflects the crystal state of the crystalline substance contained in the toner more accurately. That is, a difference in crystal state, which is not clear from the value of the half-width W10 at the above-described temperature raising rate of 10.0° C./min, can be shown more clearly by comparison with the value of the half-width W1 at a temperature raising rate of 1.0° C./min.

Regarding the toner obtained in the case where the above-described annealing treatment is not performed or the annealing treatment is insufficient, W1/W10 in the above-described formula (1) becomes a value larger than 1.00 (that is, in the case where the temperature is raised at a lower rate, the half-width increases). Furthermore, in the case where such a toner is stored over a long term, changes may occur in the crystal state of the crystalline polyester component. Therefore, degradation in low-temperature fixability and thermal storage resistance may be brought about.

On the other hand, regarding the toner obtained in the case where the annealing treatment is performed excessively (for example, in the case where the treatment is performed at a higher temperature), the value of W1/W10 becomes smaller than 0.20. Degradation in thermal storage resistance of such a toner may be brought about. As described above, the reason for this is believed to be that polymer chains, which are softened by the annealing treatment, is recrystallized as a low melting point component without being rearranged.

That is, a toner capable of keeping excellent low-temperature fixability and thermal storage resistance over a long term stably can be obtained by controlling the above-described value of W1/W10 in the range of 0.20 or more, and 1.00 or less.

In the present invention, a differential scanning calorimeter (DSC) measurement of the resulting toner particles is performed in advance, the peak temperature of the endothermic peak derived from the crystalline polyester component is determined and, thereafter, the annealing treatment temperature may be determined in accordance with the peak temperature. Specifically, the heat treatment is performed preferably at a temperature higher than or equal to the temperature determined by subtracting 15° C. from the peak temperature determined in the DSC measurement under the condition of a temperature raising rate of 10.0° C./min, and lower than or equal to the temperature determined by subtracting 5° C. from the peak temperature. The heat treatment temperature is more preferably in the range higher than or equal to the temperature determined by subtracting 10° C. from the above-described peak temperature, and lower than or equal to the temperature determined by subtracting 5° C. from the peak temperature.

In the present invention, the annealing treatment may be performed at any stage after the step to form toner particles. For example, the treatment may be applied to particles in a slurry state, the treatment may be performed before the external addition step, or the treatment may be performed after the external addition step.

The annealing treatment time can be adjusted appropriately in accordance with the proportion and the type of the crystalline polyester component in the toner and the crystal state. Usually, the annealing treatment is performed preferably in the range of 1 hour or more, and 50 hours or less. If the annealing time is less than 1 hour, a recrystallization effect is not obtained. On the other hand, if the annealing treatment exceeding 50 hours is performed, the effect is not expected any more. The annealing time is more preferably in the range of 5 hours or more, and 24 hours or less.

Moreover, in the measurement of the endothermic amount of the toner by using the differential scanning calorimeter (DSC), W20 and W10 satisfy the following formula (2), $$1.00 \leq (W20/W10) \leq 1.50 \quad (2)$$

where the half-width of a maximum endothermic peak (P20) is represented by W20 (° C.) regarding the endothermic amount derived from the binder resin in the measurement under the condition of a temperature raising rate of 20.0° C./min.

In the case where the DSC measurement is performed at a high temperature raising rate, the temperature actually applied to the toner cannot follow this, the resulting endothermic peak is shifted to the high-temperature side, and an apparent peak shape becomes broad. Therefore, a difference in thermal followability of the crystalline substance contained in the toner, that is, a difference in sharp melt property can be known by comparing the value of the half-width W10 at the above-described temperature raising rate of 10.0° C./min with the value of the half-width W20 at the temperature raising rate of 20.0° C./min.

For example, wax which can be used for a common toner is a crystalline material having a clear endothermic peak in the DSC measurement. Therefore, a toner having a half-width at a temperature raising rate of 10.0° C./min of 2.0° C. or more, and 3.5° C. or less and satisfying the above-described formula (1) may be obtained depending on the type of the wax employed.

However, regarding even the toner containing such wax, the above-described W20/W10 takes on a value exceeding 1.50.

On the other hand, as for the toner containing the crystalline polyester component having a high sharp melt property, the value of W20/W10 does not exceed 1.50 regardless of the presence or absence of the above-described heat treatment.

That is, in the case where the value of W20/W10 is within the range of 1.00 or more, and 1.50 or less, a toner exhibiting higher followability to heat and having excellent low-temperature fixability can be achieved.

Figure 3:
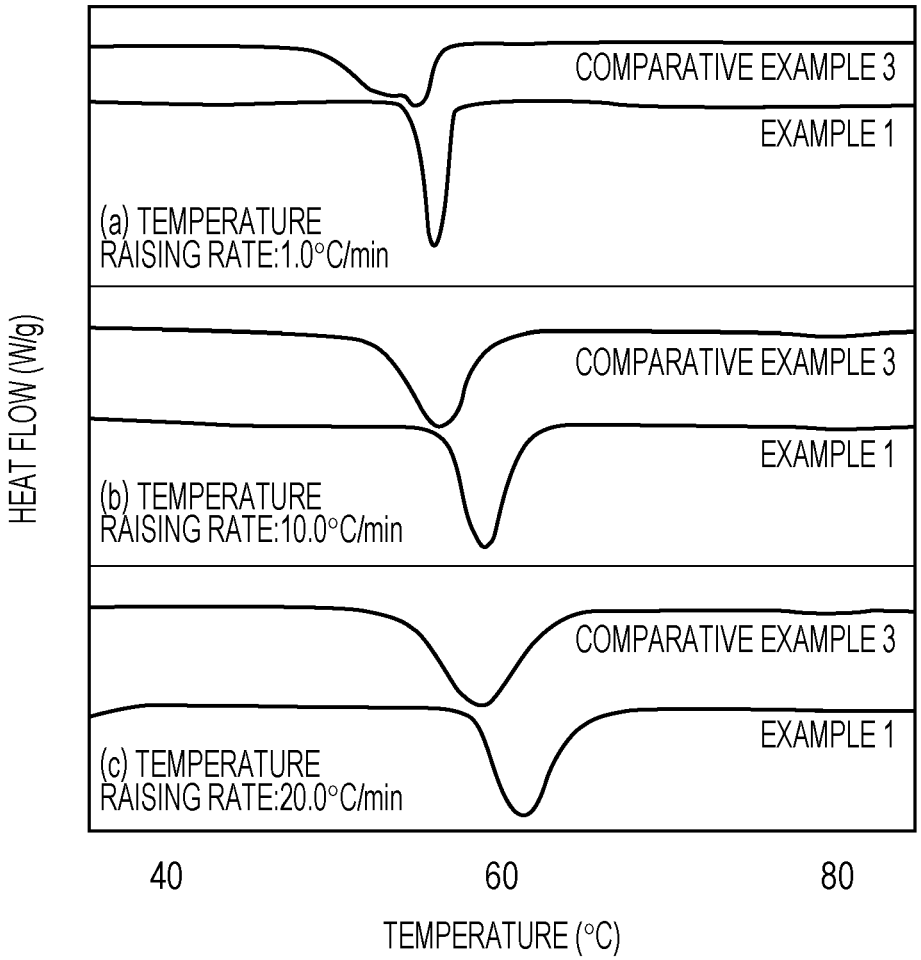
FIG. 3 is a diagram showing DSC charts derived from binder resins of toners of Example 1 and Comparative example 3.

FIG. 3 shows DSC charts of individual toners of Example 1 according to the present invention and Comparative example 3.

Regarding the toner according to the present invention, the endothermic amount per gram of the binder resin determined from the maximum endothermic peak (P10) is preferably 30 J/g or more, and 80 J/g or less. In this regard, the endothermic amount determined from the maximum endothermic peak refers to the endothermic amount calculated from the integral of area of the endothermic peak.

The endothermic amount (ΔH) of P10 represents the proportion of the crystalline substance present in the toner while being in the state, in which the crystallinity is kept, relative to the whole binder resin. That is, even in the case where the crystalline substance is present in the toner to a large extent, if the crystallinity is impaired, the ΔH is small. Therefore, the toner exhibiting ΔH in the above-described range has good low-temperature fixability because the proportion of the crystalline substance present in the toner while being in the state, in which the crystallinity is kept, is appropriate. If the ΔH is smaller than 30 J/g, the proportion of the amorphous resin component becomes large relatively. As a result, the influence of the glass transition temperature (Tg) derived from the amorphous resin component becomes larger than that of the sharp melt property of the crystalline polyester component. Consequently, it becomes difficult to exhibit good low-temperature fixability. If the ΔH exceeds 80 J/g, the proportion of the crystalline resin becomes large, dispersion of the colorant is hindered easily, and reduction in the image density occurs easily.

In GPC measurement of a THF-soluble matter of the toner, the number average molecular weight (Mn) is preferably 8,000 or more, and 30,000 or less and the weight average molecular weight (Mw) is preferably 15,000 or more, and 60,000 or less. In the case where the average molecular weight is in this range, good thermal storage resistance can be kept and, furthermore, appropriate viscoelasticity can be given to the toner. The range of Mn is more preferably 10,000 or more, and 20,000 or less, and the range of Mw is more preferably 20,000 or more, 50,000 or less. Furthermore, the Mw/Mn is preferably 6 or less. The range of the Mw/Mn is more preferably 3 or less.

In the present invention, the resin (a) containing a polyester unit as a primary component can be a copolymer, in which a segment capable of forming on a crystalline structure and a segment not forming on a crystalline structure are chemically bonded. Examples of chemically bonded copolymers include block polymers, graft polymers, and star polymers. In particular, the block polymers can be employed. The block polymer refers to a polymer in which polymers are bonded to each other in one molecule. The above-described segment capable of forming on a crystalline structure refers to a crystalline polymer chain, and when large numbers of the segments are gathered, they are arranged regularly to exhibit crystallinity. Here, a crystalline polyester chain is employed. The above-described segment not forming on a crystalline structure refers to an amorphous polymer chain, and even when the segments are gathered, they are not arranged regularly, but take on a random structure.

Examples of the above-described block polymers include forms, such as, AB type diblock polymers of a crystalline polyester (A) and another polymer (B), ABA type triblock polymers, BAB type triblock polymers, and ABAB . . . type multi-block polymers. The crystalline polyester in the block polymer forms a fine domain in the toner and, thereby, the sharp melt property of the crystalline polyester is exhibited as a whole toner, so that a low-temperature fixing effect is exerted effectively. Moreover, appropriate elasticity is also maintained easily in a fixing temperature region after sharp melt because of the above-described fine domain structure.

In the above-described block polymer, examples of bonding forms to bond the two segments include an ester bond, an urea bond, and an urethane bond. Most of all, a block polymer bonded by the urethane bond can be contained. The elasticity is maintained in the fixing region easily because of the block polymer bonded by the urethane bond.

The segment capable of forming on a crystalline structure in the above-described block polymer will be described below. In the present invention, the resin (a) contains a polyester unit as a primary component and, therefore, the segment capable of forming on a crystalline structure can be a crystalline polyester unit.

Regarding the crystalline polyester unit part, at least an aliphatic diol having the carbon number of 4 or more, and 20 or less serving as an alcohol component and a polyvalent carboxylic acid serving as an acid component can be used.

In addition, the above-described aliphatic diol can be a straight chain type. The straight chain type can further enhance the crystallinity of the toner.

Examples of the above-described aliphatic diols include the following compounds:

1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol.

Among them, from the viewpoint of the melting point, 1,4-butane diol, 1,5-pentane diol, and 1,6-hexane diol can be employed. They may be used alone or at least two types of materials may be used in combination.

Aliphatic diols having a double bond may also be used. Examples of the above-described aliphatic diols having a double bond include the following compounds:

2-butene-1,4-diol, 3-hexene-1,6-diol, and 4-octene-1,8-diol.

As for the above-described polyvalent carboxylic acid, aromatic dicarboxylic acids and aliphatic dicarboxylic acids can be used. Most of all, aliphatic dicarboxylic acids can be used. In particular, straight-chain type dicarboxylic acids can be used from the viewpoint of the crystallinity.

Examples of aliphatic dicarboxylic acids include the following compounds:

oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and lower alkyl esters and acid anhydrides thereof.

Among them, sebacic acid, adipic acid, 1,10-decanedicarboxylic acid, and lower alkyl esters and acid anhydrides thereof can be used.

Examples of aromatic dicarboxylic acids include the following compounds:

terephthalic acid, isophthalic acid, 2,6-naphthalenedicarboxylic acid, and 4,4'-biphenyldicarboxylic acid.

Among them, terephthalic acid can be used from the viewpoint of ease of availability and ease of formation of a low melting point polymer. They may be used alone or at least two types of materials may be used in combination.

Dicarboxylic acids having a double bond may also be used. The dicarboxylic acid having a double bond may be used for preventing offset in fixing because the whole resin can be cross-linked by utilizing the double bond.

Examples of such dicarboxylic acids include fumaric acid, maleic acid, 3-hexenedioic acid, and 3-octenedioic acid. The lower alkyl esters and acid anhydrides thereof are also mentioned. Among them, fumaric acid and maleic acid can be employed from the viewpoint of cost.

The method for manufacturing the above-described crystalline polyester is not specifically limited. Production may be performed by a common polyester resin polymerization method in which an acid component and an alcohol component are reacted. Production may be performed while a direct polycondensation method or a transesterification method is selected depending on the type of the monomer.

The above-described crystalline polyester is produced at a polymerization temperature of preferably 180° C. or higher, and 230° C. or lower and the reaction can be effected while, as necessary, the reaction system is decompressed and water and alcohol generated during condensation are removed. In the case where monomers are not dissolved nor mutually dissolved, a high-boiling point solvent serving as a solubilizer may be added to facilitate dissolution. The polycondensation reaction is effected while the solvent serving as the solubilizer is removed through distillation. In the case where a monomer having poor compatibility is present in a copolymerization reaction, the monomer having poor compatibility can be condensed with an acid or alcohol to be polycondensed with the monomer in advance and be subjected to polycondensation together with a primary component.

Examples of catalysts usable in production of the above-described crystalline polyester include the following catalysts:

titanium catalysts, e.g., titanium tetraethoxide, titanium tetrapropoxide, titanium tetraisopropoxide, and titanium tetrabutoxide; and tin catalysts, e.g., dibutyltin dichloride, dibutyltin oxide, and diphenyltin oxide.

The end group of the above-described crystalline polyester can be alcohol in order to prepare the above-described block polymer. Therefore, in preparation of the above-described crystalline polyester, the molar ratio (alcohol component/acid component) of the alcohol component to the acid component is specified to be preferably 1.02 or more, and 1.20 or less.

The above-described segment not forming on a crystalline structure (hereafter may be referred to as a unit constituting an amorphous part) is not specifically limited insofar as the segment is amorphous, and an amorphous resin used as a toner binder resin may be used. The glass transition temperature of the amorphous resin is preferably 50° C. or higher, and 130° C. or lower, and more preferably, 70° C. or higher, and 130° C. or lower. In the case where the glass transition temperature is in this range, the elasticity in the fixing region is maintained easily.

Examples of the above-described amorphous resins include polyurethane resins, polyester resins, styrene acrylic resins, polystyrenes, and styrene butadiene based resins. These resins may be modified with urethane, urea, and epoxy. Among them, polyester resins and polyurethane resins can be used from the viewpoint of maintenance of the elasticity. In particular, polyurethane resins can be used favorably.

The polyester resin serving as the above-described amorphous resin will be described. As for usable monomers, divalent or higher carboxylic acids and dihydric or higher alcohols in the related art are mentioned. Specific examples of these monomers are as described below.

Examples of divalent carboxylic acids include the following: dibasic acids, e.g., succinic acid, adipic acid, sebacic acid, phthalic acid, isophthalic acid, terephthalic acid, malonic acid, and dodecenyl succinic acid, anhydrides thereof, lower alkyl esters thereof, and aliphatic unsaturated dicarboxylic acids, e.g., maleic acid, fumaric acid, itaconic acid, and citraconic acid.

Examples of trivalent or higher carboxylic acids include the following: 1,2,4-benzenetricarboxylic acid, 1,2,5-benzenetricarboxylic acid, anhydrides thereof, and lower alkyl esters thereof.

They may be used alone, or at least two types may be used in combination.

Examples of dihydric alcohols include the following: bisphenol A, hydrogenated bisphenol A, bisphenol A ethylene oxide adducts, bisphenol A propylene oxide adducts, 1,4-cyclohexane diol, 1,4-cyclohexane dimethanol, ethylene glycol, and propylene glycol.

Examples of trihydric or higher alcohols include the following: glycerin, trimethylolethane, trimethylolpropane, and pentaerithritol.

They may be used alone, or at least two types may be used in combination.

For the purpose of adjusting the acid value and the hydroxyl value, as necessary, monovalent acids, e.g., acetic acid and benzoic acid, and monohydric alcohols, e.g., cyclohexanol and benzyl alcohol, may also be used.

The above-described polyester resin can be synthesized by a common polyester resin polymerization method, in the same way as the above-described crystalline polyester. For example, the transesterification method and the direct polycondensation method may be used alone or in combination.

Next, the polyurethane resin serving as the above-described amorphous resin will be described. The polyurethane resin is a reaction product of a diol and a substance containing a diisocyanate group, and a resin having various types of functionality can be obtained by adjusting the diol and the diisocyanate.

Examples of the above-described diisocyanate components include the following: aromatic diisocyanates having the carbon number (excluding carbon in a NCO group, ditto for the following) of 6 or more, and 20 or less, aliphatic diisocyanates having the carbon number of 2 or more, and 18 or less, alicyclic diisocyanates having the carbon number of 4 or more, and 15 or less, modified products (urethane group, carbodiimide group, allophanate group, urea group, biuret group, uretdione group, uretimine group, isocyanurate group, or oxazolidone-containing modified products, hereafter may be referred to as modified diisocyanates) of these diisocyanates, and mixtures of at least two types thereof.

Examples of the above-described aromatic diisocyanates include the following: m- and/or p-xylylene diisocyanate (XDI) and α,α,α',α'-tetramethylxylylene diisocyanate.

Examples of the above-described aliphatic diisocyanates include the following: ethylene diisocyanate, tetramethylene diisocyanate, hexamethylene diisocyanate (HDI), and dodecamethylene diisocyanate.

Examples of the above-described aliphatic diisocyanates include the following: isophorone diisocyanate (IPDI), dicyclohexylmethane-4,4'-diisocyanate, cyclohexylene diisocyanate, and methylcyclohexylene diisocyanate.

Among them, aromatic diisocyanates having the carbon number of 6 or more, and 15 or less, aliphatic diisocyanates having the carbon number of 4 or more, and 12 or less, and alicyclic diisocyanates having the carbon number of 4 or more, and 15 or less can be employed. In particular, XDI, IPDI, and HDI can be employed.

As for the above-described polyurethane resins, trifunctional or higher isocyanate compounds may be used in addition to the above-described diisocyanate components.

Examples of the diol components usable for the above-described urethane resin include the following: alkylene glycols (ethylene glycol, 1,2-propylene glycol, and 1,3-propylene glycol); alkylene ether glycols (polyethylene glycol and polypropylene glycol); alicyclic diols (1,4-cyclohexane dimethanol); bisphenols (bisphenol A); and alkylene oxide (ethylene oxide and propylene oxide) adducts of the above-described alicyclic diols.

Alkyl parts of the above-described alkylene glycol and the alkylene ether glycol may be in the shape of a straight chain or be branched. In the present invention, alkylene glycols having a branched structure can also be used.

As for the method for preparing the block polymer, a method (two-step method), in which a unit constituting the crystal part and a unit constituting the amorphous part are prepared separately and the two are bonded, may be used. Alternatively, a method (one-step method), in which a unit constituting the crystal part and a unit constituting the amorphous part are charged at the same time and the preparation is performed in one operation, may also be used.

The block polymer in the present invention may be synthesized by a method selected from various methods in consideration of the reactivity of the individual end functional groups.

In the case where both the crystal part and the amorphous part of the block polymer are polyester resins, the individual units may be prepared separately and be bonded by using a binder, so as to prepare the block polymer. In particular, in the case where one polyester has a high acid value and the other polyester has a high hydroxyl value, the binder is not necessarily used, the condensation reaction may be effected through heating and decompression without any other treatment. At this time, the reaction temperature is preferably about 200° C.

In the case where the binder is used, examples of binders include the following: polyvalent carboxylic acids, polyhydric alcohols, polyvalent isocyanates, polyfunctional epoxy, and polyvalent acid anhydrides. These binders may be used, and synthesis may be performed by a dehydration reaction or an addition reaction.

In the case where the crystal part of the block polymer is a polyester resin and the amorphous part is a polyurethane resin, the individual units may be prepared separately and the block polymer may be prepared by an urethane-forming reaction between an alcohol end of the crystalline polyester and an isocyanate end of the polyurethane. Alternatively, synthesis may be performed by mixing and heating the crystalline polyester having an alcohol end and a diol and a diisocyanate constituting the polyurethane. In this case, at an initial stage of the reaction, the concentrations of the above-described diol and the diisocyanate are high and they react selectively to form a polyurethane, and after the molecular weight reaches a certain level, urethane formation occurs between an isocyanate end of the polyurethane and an alcohol end of the crystalline polyester.

In order to exert an effect of the above-described block polymer effectively, presence of homopolymers of the above-described crystalline polyester and the amorphous substance in the toner can be minimized. That is, the degree of block formation can be high.

The above-described resin (a) contains preferably 50 percent by mass or more of segment capable of forming on a crystalline structure (resin component (a1)) relative to the above-described resin (a). In the case where the above-described resin (a) is a block polymer, the composition ratio of the segment capable of forming on a crystalline structure in the block polymer is preferably 50 percent by mass or more. In the case where the content of the resin component (a1) is 50 percent by mass or more, the sharp melt property is easily effectively exhibited. The content is more preferably 60 percent by mass or more.

The content of a segment not forming on a crystalline structure (resin component (a2)) is preferably 10 percent by mass or more relative to the above-described resin (a). In the case where the content of the resin component (a2) is 10 percent by mass or more, the elasticity after the sharp melt is maintained favorably. The content is more preferably 15 percent by mass or more.

That is, the proportion of the resin component (a1) relative to the above-described resin (a) is preferably 50 percent by mass or more, and 90 percent by mass or less, and more preferably 60 percent by mass or more, and 85 percent by mass or less.

The binder resin in the present invention may contain other resins known as toner binder resins in the related art in addition to the above-described resin (a). The content at that time is not specifically limited, but the other resins can be contained in such a way that the endothermic amount of the maximum endothermic peak (P10) derived from the binder resin becomes 30 J/g or more, and 80 J/g or less. As a guide, the content of the resin (a) in the binder resin is preferably 70 percent by mass or more, and the content is more preferably 85 percent by mass or more.

Examples of wax used in the present invention include the following: aliphatic hydrocarbon based wax, e.g., low molecular weight polyethylenes, low molecular weight polypropylenes, low molecular weight olefin copolymers, microcrystalline wax, paraffin wax, and Fischer-Tropsch wax; oxides of aliphatic hydrocarbon based wax, e.g., oxidized polyethylene wax; wax containing an aliphatic ester as a primary component, e.g., aliphatic hydrocarbon based ester wax; wax produced by deacidifying a part of or whole aliphatic ester, e.g., deacidified carnauba wax; partial esterification products of an aliphatic acid and a polyhydric alcohol, e.g., behenic acid monoglyceride; and hydroxyl-containing methyl ester compounds obtained by hydrogenating vegetable fat and oil.

Regarding wax which can be particularly used in the present invention, in a dissolution suspension method, aliphatic hydrocarbon based wax and ester wax can be employed from the viewpoint of ease of preparation of a wax dispersion liquid, ease of being taken into the toner prepared, an exudation property from the toner during fixing, and releasability.

As for the ester wax in the present invention, either natural ester wax or synthesized ester wax may be used insofar as at least one ester bond is included in one molecule.

Examples of synthesized ester wax include monoester wax synthesized from a long-chain straight-chain saturated aliphatic acid and a long-chain straight-chain saturated alcohol.

The long-chain straight-chain saturated aliphatic acid represented by a general formula $C_nH_{2n+1}COOH$, where n=5 or more, and 28 or less, can be used. The long-chain straight-chain saturated alcohol represented by a general formula $C_nH_{2n+1}OH$, where n=5 or more, and 28 or less, can be used.

Examples of natural ester wax include candelilla wax, carnauba wax, rice wax, and derivatives thereof.

Among the above-described wax, in particular, the synthesized ester wax from the long-chain straight-chain saturated aliphatic acid and the long-chain straight-chain saturated alcohol or the natural ester wax containing the above-described ester as a primary component can be employed.

Furthermore, in the present invention, the ester can be a monoester in addition to the straight-chain structure.

In the present invention, the content of wax in the toner is preferably 2 parts by mass or more, and 20 parts by mass or less, and more preferably 2 parts by mass or more, and 15 parts by mass or less relative to 100 parts by mass of binder resin. In the case where the wax content is within the above-described range, the releasability of the toner can be kept favorably, exposure of wax at the toner surface can be suppressed favorably, and the thermal storage resistance can be maintained favorably.

The above-described wax can exhibit a maximum endothermic peak in the range of 60° C. or higher, and 120° C. or lower in the differential scanning calorimeter (DSC) measurement. In the case where the peak temperature is in the above-described range, the thermal storage resistance, the low-temperature fixability, and the offset resistance can be improved while the balance is kept.

The toner according to the present invention contains a colorant to give a coloring power. Examples of colorants, which can be used in the present invention, include organic pigments, organic dyes, inorganic pigments, carbon black serving as a black colorant, and magnetic powders, and colorants used for toners in the relates art may be used.

Examples of yellow colorants include the following: condensed azo compounds, isoindolinone compounds, anthraquinone compounds, azo metal complexes, methine compounds, and allylamide compounds. Specifically, C. I. Pigment Yellow 12, 13, 14, 15, 17, 62, 74, 83, 93, 94, 95, 109, 110, 111, 128, 129, 147, 168, and 180 can be used.

Examples of magenta colorants include the following: condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specifically, C. I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254 can be used.

Examples of cyan colorants include the following: copper phthalocyanine compounds and derivatives thereof, anthraquinone compounds, and basic dye lake compounds. Specifically, C. I. Pigment Blue 1, 7, 15, 15:1, 15:2, 15:3, 15:4, 60, 62, and 66 can be used.

These colorants may be used alone or in combination. Furthermore, it is also possible to use in the state of solid solution.

The colorant used for the present invention is selected from the viewpoint of the hue angle, the saturation, the brightness, the lightfastness, the OHP transparency, and dispersibility in the toner.

The amount of addition of the above-described colorant to be used is preferably 1 part by mass or more, and 20 parts by mass or less relative to 100 parts by mass of the binder resin. Likewise, in the case where the carbon black is used as the black colorant, the amount of addition is preferably 1 part by mass or more, and 20 parts by mass or less.

In the case where the toner is produced in an aqueous medium, it is necessary to note the property to migrate to a water phase of these colorants, and as necessary, a surface treatment, e.g., a hydrophobic treatment, can be performed. Examples of methods for surface-treating a dye based colorant can include a method in which the polymerizable monomer is polymerized in the presence of a dye in advance. Regarding the carbon black, besides the same treatment as that for the above-described dye, a graft treatment with a substance, e.g., polyorganosiloxane, which reacts with a surface functional group of the carbon black, may be performed.

In the case where a magnetic powder is used as the black colorant, the amount of addition thereof is preferably 40 parts by mass or more, and 150 parts by mass or less relative to 100 parts by mass of binder resin.

The magnetic powder contains iron oxide, e.g., triiron tetroxide or γ-ferric oxide, as a primary component and has hydrophilicity in general. Therefore, in the case where the toner is produced in the aqueous medium, the magnetic powder tends to localize on the particle surface because of interaction with water. Consequently, the resulting toner particles exhibit poor fluidity and uniformity in triboelectric charging because of the magnetic powder exposed at the surface. Then, the surface of the magnetic powder can be subjected to a uniform hydrophobic treatment with a coupling agent. Examples of usable coupling agents include silane coupling agents and titanium coupling agents. In particular, the silane coupling agent can be used.

Regarding the toner according to the present invention, as necessary, a charge control agent may also be used by being mixed with toner particles. Alternatively, the charge control agent may be added in production of toner particles. The charge characteristics can be stabilized and an optimum amount of triboelectric charging can be controlled in accordance with the development system by blending the charge control agent.

As for the charge control agent, known agents may be used. In particular, a charge control agent having a high charging speed and being capable of maintaining a constant amount of charge stably can be employed.

As for the charge control agent to control a negative charge characteristic of the toner, organometallic compounds and chelate compounds are effective, and examples thereof include monoazo metal compounds, acetyl acetone metal compounds, and metal compounds of aromatic oxycarboxylic acid, aromatic dicarboxylic acid, oxycarboxylic acid, and dicarboxylic acid base. Examples of charge control agents to control a positive charge characteristic of the toner include nigrosine, quaternary ammonium salts, metal salts of higher aliphatic acids, diorganotin borates, guanidine compounds, and imidazole compounds. The toner according to the present invention may contain one type of these charge control agents or at least two types of them in combination.

In the case where the charge control agent is used, the amount of blend is preferably 0.01 parts by mass or more, and 20 parts by mass or less, and more preferably 0.5 parts by mass or more, and 10 parts by mass or less relative to 100 parts by mass of binder resin.

The toner according to the present invention can be a toner produced with no heating. The toner produced with no heating refers to a toner which has never undergone a temperature higher than the melting point of the crystalline polyester during production of the toner. In this regard, heating during production of the crystalline polyester is not taken into consideration. If the crystalline polyester is heated at a temperature higher than or equal to the melting point, the crystallinity tends to be impaired. In the case where the toner is produced with no heating, the toner can be produced without impairing the crystallinity of the crystalline polyester and, therefore, the crystallinity is maintained easily, so that the toner according to the present invention can be realized easily. Examples of toner manufacturing methods with no heating include a dissolution suspension method.

The dissolution suspension method is a method in which the resin component is dissolved into an organic solvent, the resulting resin solution is dispersed in an aqueous medium to form oil droplets and, thereafter, the organic solvent is removed, so as to obtain toner particles.

In production of the toner containing the crystalline polyester component according to the present invention, carbon dioxide in a high pressure state may be used as a dispersion medium. That is, in the method, the above-described resin solution is dispersed into carbon dioxide in the high pressure state so as to be granulated, the organic solvent contained in the granulated particles is removed by extraction into a carbon dioxide phase and, thereafter, carbon dioxide is separated by relieving pressure, so as to obtain toner particles. Carbon dioxide, which can be used in the present invention, in the high pressure state refers to carbon dioxide in a liquid or supercritical state.

Here, liquid carbon dioxide refers to carbon dioxide under the temperature and pressure condition in a portion surrounded by a gas-liquid boundary line passing through a triple junction (temperature=−57° C., pressure=0.5 MPa) on a phase diagram of carbon dioxide and a critical point (temperature=31° C., pressure=7.4 MPa), an isotherm of critical temperature, and a solid-liquid boundary line. Furthermore, carbon dioxide in a supercritical state refers to carbon dioxide under the temperature and pressure condition higher than or equal to the above-described critical point of carbon dioxide.

In the present invention, the suspension medium may contain an organic solvent as another component. In this case, carbon dioxide and the organic solvent can form a homogeneous phase.

In particular, this method can be employed because granulation is performed at a high pressure and, therefore, not only the crystallinity of the crystalline polyester component is maintained easily, but also it is possible to enhance the crystallinity.

A method for manufacturing toner particles will be described as an example, which is suitable for obtaining the toner particles according to the present invention and in which carbon dioxide in a liquid or supercritical state is used as a dispersion medium.

Initially, the resin (a), the colorant, the wax, and, as necessary, other additives are added to the organic solvent capable of dissolving the resin (a), and uniform dissolution or dispersion is effected with a dispersing machine, e.g., a homogenizer, a ball mill, a colloid mill, or an ultrasonic dispersing machine.

Subsequently, the thus obtained solution or dispersion liquid (hereafter simply referred to as a resin (a) solution) is dispersed into carbon dioxide in a liquid or supercritical state to form oil droplets.

At this time, it is necessary that a dispersing agent is dispersed in carbon dioxide serving as a dispersing medium in a liquid or supercritical state. As for the dispersing agent, any of inorganic fine particle dispersing agents, organic fine particle dispersing agents, and mixtures thereof is employed. They may be used alone or at least two types may be used in combination in accordance with the purpose.

Examples of the above-described inorganic fine particle dispersing agents include inorganic particles of silica, alumina, zinc oxide, titania, and calcium oxide.

Examples of the above-described organic fine particle dispersing agents include vinyl resins, urethane resins, epoxy resins, ester resins, polyamides, polyimides, silicone resins, fluororesins, phenol resins, melamine resins, benzoguanamine based resins, urea resins, aniline resins, ionomer resins, polycarbonates, cellulose, and mixtures thereof.

In the case where organic resin fine particles composed of an amorphous resin are used as the dispersing agent, carbon dioxide is dissolved into the above-described resin to plasticize the resin and lower the glass transition temperature, so that aggregation of particles occurs easily in granulation. Therefore, a resin having the crystallinity can be used as the organic resin fine particles. In the case where the amorphous resin is used, a cross-linking structure can be introduced. Alternatively, fine particles produced by covering amorphous resin particles with a crystalline resin may be employed.

The above-described dispersing agent may be used as-is. However, the dispersing agent subjected to surface modification with various treatments may be used in order to improve the adsorptivity to the above-described oil droplet surface in granulation. Specific examples include surface treatments with silane based, titanate based, and aluminate based coupling agents, surface treatments with various surfactants, and coating treatments with polymers.

The dispersing agent adsorbed to the surface of the oil droplet remains as-is after toner particles are formed. Therefore, in the case where resin fine particles are used as the dispersing agent, toner particles with surfaces covered with the resin fine particles can be formed.

The particle diameter of the above-described resin fine particles is preferably 30 nm or more, and 300 nm or less on a number average particle diameter basis, and more preferably 50 nm or more, and 100 nm or less. In the case where the particle diameter of the resin fine particles is too small, the stability of the oil droplet tends to reduce in granulation. In the case where the particle diameter is too large, it becomes difficult to control the particle diameter of the oil droplet to a desired size.

The amount of blend of the above-described resin fine particles is preferably 3.0 parts by mass or more, and 15.0 parts by mass or less relative to the amount of solid in the above-described resin (a) solution used for forming oil droplets and may be adjusted appropriately in accordance with the stability and a desired particle diameter of the oil droplet.

In the present invention, as for the method for dispersing the above-described dispersing agent into carbon dioxide in a liquid or supercritical state, any method may be used. Specific examples include a method in which the above-described dispersing agent and carbon dioxide in a liquid or supercritical state are charged into a container and are dispersed directly through agitation or ultrasonic irradiation. Alternatively, a method is mentioned, wherein a dispersion liquid in which the above-described dispersing agent is dispersed into an organic solvent is introduced by using a high-pressure pump into a container charged with carbon dioxide in a liquid or supercritical state.

In the present invention, as for the method for dispersing the above-described resin (a) solution into carbon dioxide in a liquid or supercritical state, any method may be used. Specific examples include a method, wherein the above-described resin (a) solution is introduced by using a high-pressure pump into a container including carbon dioxide in a liquid or supercritical state, in which the above-described dispersing agent is dispersed. Alternatively, carbon dioxide in a liquid or supercritical state, in which the above-described dispersing agent is dispersed, may be introduced into a container charged with the above-described resin (a) solution.

In the present invention, it is important that the dispersion medium on the basis of the above-described carbon dioxide in a liquid or supercritical state is a single phase. In the case where granulation is performed by dispersing the above-described resin (a) solution into carbon dioxide in a liquid or supercritical state, a part of the organic solvent in the oil droplet is shifted into the dispersion medium. At this time, it is not favorable that the phase of carbon dioxide and the phase of the organic solvent are present in a separate state because the stability of the oil droplet is impaired. Therefore, the temperature and the pressure of the above-described dispersion medium and the amount of the above-described resin (a) solution relative to carbon dioxide in a liquid or supercritical state can be adjusted to become within the range in which carbon dioxide and the organic solvent can form a homogeneous phase.

Regarding the temperature and the pressure of the above-described dispersion medium, it is also necessary to pay attention to the granulation performance (ease of oil droplet formation) and the solubility of the constituents of the above-described resin (a) solution into the above-described dispersion medium. For example, the resin (a) and the wax in the above-described resin (a) solution may be dissolved into the above-described dispersion medium depending on the temperature condition and the pressure condition. Usually, the solubility of the above-described components into the dispersion medium is reduced as the temperature becomes low and the pressure becomes low. However, aggregation and coalescence of formed oil droplets occur easily and, thereby, the granulation performance is reduced. On the other hand, as the temperature becomes high and the pressure becomes high, the granulation performance is improved, but the above-described components tend to be dissolved into the above-described dispersion medium easily.

In order that the crystallinity of the crystalline polyester component is not impaired, it is necessary that the temperature of the above-described dispersion medium is lower than the melting point of the crystalline polyester component.

Therefore, in production of the toner particles according to the present invention, the temperature of the above-described dispersion medium is preferably within the range of 20° C. or higher, and lower than the melting point of the crystalline polyester component.

The pressure in the container to form the above-described dispersion medium is preferably 3 MPa or more, and 20 MPa or less, and more preferably 5 MPa or more, and 15 MPa or less. In this regard, the pressure in the present invention refers to a total pressure in the case where components other than carbon dioxide is contained in the dispersion medium.

The proportion of carbon dioxide constituting the dispersion medium in the present invention is preferably 70 percent by mass or more, more preferably 80 percent by mass or more, and further preferably 90 percent by mass or more.

After the granulation is completed, as described above, the organic solvent remaining in the oil droplet is removed through dispersion medium on the basis of carbon dioxide in a liquid or supercritical state. Specifically, carbon dioxide in a liquid or supercritical state is further mixed into the above-described dispersion medium, in which oil droplets are dispersed, to extract the remaining organic solvent to the phase of carbon dioxide and, furthermore, the resulting carbon dioxide containing the organic solvent is replaced with carbon dioxide in a liquid or supercritical state.

As for the mixing of the above-described dispersion medium and the above-described carbon dioxide in a liquid or supercritical state, carbon dioxide in a liquid or supercritical state at a pressure higher than that of the dispersion medium may be added to the dispersion medium, or the above-described dispersion medium may be added to carbon dioxide in a liquid or supercritical state at a pressure lower than that of the dispersion medium.

As for the method for further replacing carbon dioxide containing the organic solvent with carbon dioxide in a liquid or supercritical state, a method is mentioned, wherein carbon dioxide in a liquid or supercritical state is passed through while the pressure in the container is kept constant. At this time, formed toner particles are captured with a filter.

If replacement with the above-described carbon dioxide in a liquid or supercritical state is not sufficient and the organic solvent remains in the dispersion medium, when the container is decompressed in order to recover the resulting toner particles, the organic solvent dissolved in the above-described dispersion medium may be condensed, so that the toner particles may be dissolved again or toner particles may coalesce. Therefore, it is necessary that the replacement with the above-described carbon dioxide in a liquid or supercritical state is performed until the organic solvent is removed completely. The amount of carbon dioxide in a liquid or supercritical state passed through is preferably 1 time the volume of the above-described dispersion medium or more, and 100 times or less, further preferably 1 time or more, and 50 times or less, and most preferably 1 time or more, and 30 times or less.

When the container is decompressed and toner particles are taken out of the dispersion containing carbon dioxide in a liquid or supercritical state, in which the toner particles are dispersed, the pressure may be reduced to ambient temperature and normal pressure in one stroke or may be reduced stepwise by disposing multistage containers where the pressures are controlled individually. The decompression rate can be set within the range in which toner particles are not foamed.

The organic solvent and carbon dioxide in a liquid or supercritical state used in the present invention may be recycled.

Moreover, in the present invention, the toner particles taken out are subjected to an annealing treatment at a temperature condition lower than the melting point of the crystalline polyester component. The specific method of the annealing treatment is as described above. Consequently, the crystalline structure of the crystalline polyester component in the toner particles can be improved effectively. The endothermic peak, which is obtained by the DSC measurement of the resulting toner and which results from the crystalline polyester component, takes on a very sharp peak shape with small expanse of tail on the low-temperature side.

Regarding the thus obtained toner, changes do not occur in the crystalline structure of the contained crystalline polyester component even over long-term storage, and excellent low-temperature fixability and thermal storage resistance can be maintained stably.

An inorganic fine powder serving as a fluidity improver can be added to the toner particles.

Examples of inorganic fine powders added include fine powders, e.g., silica fine powders, titanium oxide fine powders, alumina fine powders, and oxide complex fine powders thereof. Among these inorganic fine powders, silica fine powders and titanium oxide fine powders are employed.

Examples of silica fine powders include dry silica or fumed silica produced by vapor phase oxidation of a silicon halide and wet silica produced from water glass. As for the inorganic fine powder, the dry silica can be employed because presence of silanol groups on the surface and in the inside of silica fine powder is at a small extent, and presence of $Na_2O$ and $SO_3^{2-}$ is at a small extent. The dry silica may be a complex fine powder composed of silica and other metal oxides, which are produced by using metal halide compounds, e.g., aluminum chloride and titanium chloride, together with silicon halide compounds in a production step.

The inorganic fine powder can be externally added to the toner particles for the purpose of improving the fluidity of the toner and leveling charges of toner particles. The adjustment of the amount of charge of the toner, an improvement in the environmental stability, and an improvement in characteristics in a high-humidity environment can be achieved by subjecting the inorganic fine powder to a hydrophobic treatment. Therefore, an inorganic fine powder subjected to the hydrophobic treatment can be used.

Examples of treatment agents of the hydrophobic treatment of the inorganic fine powder include unmodified silicone varnishes, various modified silicone varnishes, unmodified silicone oils, various modified silicone oils, silane compounds, silane coupling agents, other organosilicon compounds, and organic titanium compounds. These treatment agents may be used alone or in combination.

Among them, the inorganic fine powder treated with the silicone oil can be employed. In particular, a hydrophobic-treated inorganic fine powder produced by hydrophobic-treating the inorganic fine powder with the coupling agent and, at the same time or thereafter, treating with the silicone oil can be employed. In this case, the amount of charge of the toner particles can be maintained at a high level even in a high-humidity environment and selective development can be suppressed favorably.

The amount of addition of the above-described inorganic fine powder is preferably 0.1 parts by mass or more, and 4.0 parts by mass or less relative to 100 parts by mass of toner particles, and more preferably 0.2 parts by mass or more, and 3.5 parts by mass or less. In the case where the amount is within the above-described range, a fluidity improving effect is obtained sufficiently, and an occurrence of member contamination is suppressed.

Regarding the toner according to the present invention, the weight average particle diameter (D4) is preferably 3.0 μm or more, and 8.0 μm or less, and further preferably 5.0 μm or more, and 7.0 μm or less. The toner having such a weight average particle diameter (D4) can be used for ensuring good handleability and satisfying the reproducibility of dots sufficiently.

The ratio (D4/D1) of the weight average particle diameter (D4) to the number average particle diameter (D1) of the toner according to the present invention is preferably 1.25 or less, and more preferably 1.20 or less.

The methods for measuring various properties of the toner according to the present invention will be described below.

Method for Measuring Weight Average Particle Diameter (D4) and Number Average Particle Diameter (D1)

The weight average particle diameter (D4) and the number average particle diameter (D1) of the toner are calculated as described below.

As for the measuring apparatus, a precise particle size distribution measurement apparatus "Coulter Counter Multisizer 3" (registered trademark, produced by Beckman Coulter, Inc.) equipped with a 100 μm aperture tube on the basis of pore electric resistance method is used. Regarding setting of the measurement conditions and analysis of the measurement data, an attached dedicated software "Beckman Coulter Multisizer 3 Version 3.51" (produced by Beckman Coulter, Inc.) is used. In this regard, the measurement is performed with the number of effective measurement channels of 25,000 channels.

As for the electrolytic aqueous solution used for the measurement, a solution prepared by dissolving special grade sodium chloride into ion-exchanged water in such a way as to have a concentration of about 1 percent by mass, for example, "ISOTON II" (produced by Beckman Coulter, Inc.), can be used.

By the way, prior to the measurement and the analysis, the above-described dedicated software is set as described below.

In the screen of "Modification of the standard operating method (SOM)" of the above-described dedicated software, the total count number in the control mode is set at 50,000 particles, the number of measurements is set at 1 time, and the Kd value is set at a value obtained by using "Standard particles 10.0 μm" (produced by Beckman Coulter, Inc.). The threshold value and the noise level are automatically set by pressing "Threshold value/noise level measurement button". In addition, the current is set at 1,600 μA, the gain is set at 2, the electrolytic solution is set at ISOTON II, and a check is entered in "Post-measurement aperture tube flush".

In the screen of "Setting of conversion from pulses to particle diameter" of the above-described dedicated software, the bin interval is set at logarithmic particle diameter, the particle diameter bin is set at 256 particle diameter bins, and the particle diameter range is set at 2 μm to 60 μl.

The specific measurement procedure is as described below.

(1) A 250 ml round-bottom glass beaker dedicated to Multisizer 3 is charged with about 200 ml of the above-described electrolytic aqueous solution, the beaker is set in a sample stand, and counterclockwise agitation is performed with a stirrer rod at 24 revolutions/sec. Then, contamination and air bubbles in the aperture tube are removed by "Aperture flush" function of the dedicated software.

(2) A 100 ml flat-bottom glass beaker is charged with about 30 ml of the above-described electrolytic aqueous solution. A diluted solution is prepared by diluting "Contaminon N" (a 10 percent by mass aqueous solution of neutral detergent for washing a precision measuring device, including a nonionic surfactant, an anionic surfactant, and an organic builder and having a pH of 7, produced by Wako Pure Chemical Industries, Ltd.) with ion-exchanged water by a factor of about 3 on a mass basis and about 0.3 ml of the diluted solution serving as a dispersing agent is added to the inside of the beaker.

(3) An ultrasonic dispersing machine "Ultrasonic Dispersion System Tetora 150" (produced by Nikkaki Bios Co., Ltd.) is prepared, the system incorporating two oscillators with an oscillatory frequency of 50 kHz in such a way that the phases are displaced by 180 degrees and having an electrical output of 120 W. Then, about 3.3 l of ion-exchanged water is put into a water tank of the ultrasonic dispersion system, and about 2 ml of Contaminon N is added to the inside of this water tank.

(4) The beaker in the above-described item (2) is set in a beaker fixing hole of the above-described ultrasonic dispersion system, and the ultrasonic dispersion system is actuated. The height position of the beaker is adjusted in such a way that the resonance state of the liquid surface of the electrolytic aqueous solution in the beaker is maximized.

(5) Ultrasonic waves are applied to the electrolytic aqueous solution in the beaker of the above-described item (4). In this state, about 10 mg of toner is added to the above-described electrolytic aqueous solution little by little and is dispersed. Subsequently, an ultrasonic dispersion treatment is further continued for 60 seconds. In this regard, in the ultrasonic dispersion, the water temperature of the water tank is controlled at 10° C. or higher, and 40° C. or lower appropriately.

(6) The electrolytic aqueous solution, in which the toner is dispersed, of the above-described item (5) is dropped to the round-bottom beaker of the above-described item (1) set in the sample stand by using a pipette in such a way that the measurement concentration is adjusted to become about 5%. Then, the measurement is performed until the number of measured particles reaches 50,000.

(7) The measurement data are analyzed by the above-described dedicated software attached to the apparatus, so that the weight average particle diameter (D4) and the number average particle diameter (D1) are calculated. In this regard, when Graph/percent by volume is set in the above-described dedicated software, "Average diameter" on the screen of "Analysis/statistical value on volume (arithmetic average)" is the weight average particle diameter (D4), and when Graph/percent by the number is set in the above-described dedicated software, "Average diameter" on the screen of "Analysis/statistical value on the number (arithmetic average)" is the number average particle diameter (D1).

Methods for Measuring Endothermic Peak Temperature, Endothermic Amount, and Half-Width The endothermic peak temperatures Tp of the toner, the crystalline polyester used as a material therefor, and the block polymer are measured by using DSC Q1000 (produced by TA Instrument) under the following condition.

Temperature raising rate: 1° C./min, 10° C./min, or 20° C./min

Measurement start temperature: 20° C.

Measurement stop temperature: 180° C.

The melting points of indium and zinc are used for temperature correction of the detecting portion of the apparatus, and the heat of fusion of indium is used for the correction of the amount of heat.

Specifically, about 5 mg of sample is weighed precisely and is put into a silver pan. Then, the measurement is performed. An empty silver pan is used as a reference.

In the case where the sample is the toner, when the maximum endothermic peak (endothermic peak derived from the binder resin) and the endothermic peak derived from the wax do not overlap with each other, the obtained maximum endothermic peak is considered as-is to be the endothermic peak derived from the binder resin. Meanwhile, in the case where the sample is the toner, when the endothermic peak derived from the wax and the maximum endothermic peak derived from the binder resin overlap with each other, it is necessary to subtract the endothermic amount derived from the wax from the maximum endothermic peak.

For example, the endothermic peak derived from the binder resin can be obtained by subtracting the endothermic amount derived from the wax from the obtained maximum endothermic peak following the method described below.

The DSC measurement of only the wax is performed separately, so as to determine the endothermic characteristic. The wax content in the toner is determined. The measurement of the wax content in the toner may be performed through, for example, separation of peaks in the DSC measurement or structure analysis in the related art, although not specifically limited. The endothermic amount derived from the wax may be calculated from the wax content in the toner and the resulting value may be subtracted from the maximum endothermic peak. In the case where the wax is much compatible with the resin component, it is necessary that the endothermic amount derived from the wax is calculated on the basis of the above-described wax content multiplied by the compatibility factor and is subtracted from the maximum endothermic peak. The compatibility factor is calculated from the value determined by dividing the endothermic amount of a mixture composed of the melt-mixture of the resin component and the wax at a predetermined ratio by a theoretical endothermic amount calculated from the endothermic amount of the above-described melt-mixture and the endothermic amount of only the wax determined in advance.

In the measurement, in order to determine the endothermic amount per gram of binder resin, it is necessary that the mass of the components other than the binder resin is subtracted from the mass of the sample.

The content of the components other than the binder resin can be measured by an analytical method in the related art. In the case where the analysis is difficult, the amount of incineration residue ash of the toner is determined, the amount of wax and the like, which are incinerated and which are components other than the binder resin, is added to the amount of ash, and the resulting value is taken as the amount of components other than the binder resin. Therefore, the amount of the binder resin is determined by subtracting the resulting value from the mass of the toner.

The incineration residue ash of the toner is determined by the following procedure. About 2 g of toner is put into a 30 ml magnetic crucible weighed in advance. The crucible is put into an electric furnace, is heated at about 900° C. for about 3 hours, is stood for cooling in the electric furnace, and is stood for cooling in a desiccator at ambient temperature for 1 hour or more. The mass of the crucible including incineration residue ash is weighed and the mass of the crucible is subtracted, so as to calculate the incineration residue ash.

In this regard, in the case where a plurality of peaks are present, the maximum endothermic peak refers to the peak exhibiting a maximum endothermic amount. Regarding the above-described maximum endothermic peak, the temperature width at the height (½h) one-half of the peak height (h) is determined and this is taken as the half-width.

Method for Measuring Molecular Weight (Mn, Mw) of THF-Soluble Matter

In the present invention, the number average molecular weights (Mn) and the weight average molecular weights (Mw) of the toner and the tetrahydrofuran (THF)-soluble matter serving as the material therefor are measured by gel permeation chromatography (GPC) in a manner as described below.

(1) Preparation of Measurement Sample

The resin (sample) and THF are mixed at a concentration of about 0.5 to 5 mg/ml (for example, about 5 mg/ml). The mixture is stood at room temperature for several hours (for example, 5 to 6 hours), and was shaken sufficiently, so that THF and the sample is mixed well until a coalescent body of the sample is not present. Furthermore, standing is performed at room temperature for 12 hours or more (for example, 24 hours). At this time, the time from the start point of mixing of the sample and THF to the stop point of standing is specified to be 24 hours or more.

Subsequently, the resulting solution is passed through a sample treatment filter (Maishori Disk H-25-2 (produced by Tosoh Corporation), pore size 0.45 to 0.5 μm, or EKICRO-DISK 25CR (produced by Gelman Sciences, Japan, Ltd.) can be used) is employed as the sample for GPC.

(2) Measurement of Sample

A column is stabilized in a heat chamber at 40° C., THF serving as a solvent is passed through the column at this temperature at a flow rate of 1 ml/min, and 50 to 200 μl of THF sample solution of the resin is injected while the sample concentration is adjusted to be 0.5 to 5 mg/ml, so as to be measured.

In measurement of the molecular weight of the sample, a molecular weight distribution of the sample is calculated on the basis of the relationship between the logarithmic value and the number of counts of the calibration curve formed by using several types of monodispersion polystyrene standard samples.

As for the polystyrene standard samples for forming a calibration curve, the standard samples having molecular weights of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$ produced by Pressure Chemical Co., or produced by Tosoh Corporation are used. As for a detector, a refractive index (RI) detector is used.

As for the column, a plurality of commercially available polystyrene gel columns are used in combination, as described below, in order to measure molecular weights in a region of $1\times10^3$ to $2\times10^6$ accurately. In the present invention, the GPC measurement condition are as described below.

GPC Measurement Condition

Apparatus: LC-GPC 150C (produced by Waters Corporation)

Column: seven-gang of KF-801, 802, 803, 804, 805, 806, and 807 (produced by Shodex)

Column temperature: 40° C.

Mobile phase: tetrahydrofuran (THF)

Method for Measuring Particle Diameter of Resin Fine Particles

The particle diameter of resin fine particles used for the toner according to the present invention is measured on the basis of the number average particle diameter (μm or nm) by using Microtrac particle size distribution measuring apparatus HRA (X-100) (produced by NIKKISO CO., LTD.) with a range setting of 0.001 μm to 10 μl. As for a dilution solvent, water is selected.

Method for Measuring Glass Transition Temperature

The glass transition temperature of the amorphous resin is measured by using DSC Q1000 (produced by TA Instrument) under the following condition.

Measurement mode: modulation mode

Temperature raising rate: 2° C./min

Modulation temperature amplitude: ±0.6° C./min

Frequency: one time/min

Measurement start temperature: 20° C.

Measurement stop temperature: 150° C.

The melting points of indium and zinc are used for temperature correction of the detecting portion of the apparatus, and the heat of fusion of indium is used for the correction of the amount of heat.

Specifically, about 5 mg of sample is weighed precisely and is put into a silver pan. Then, the measurement is performed where an empty silver pan is used as a reference. The measurement is only one time. Tangent lines of the curve indicating endotherm and the base lines before and after thereof are drawn, a midpoint of straight lines passing through intersections of the individual tangent lines is determined from an obtained reversing heat flow curve in temperature raising, and this is taken as the glass transition temperature.

Method for Measuring Melting Point of Wax

The melting point of the wax is measured by using DSC Q1000 (produced by TA Instrument) under the following condition.

Temperature raising rate: 10° C./min

Measurement start temperature: 20° C.

Measurement stop temperature: 180° C.

The melting points of indium and zinc are used for temperature correction of the detecting portion of the apparatus, and the heat of fusion of indium is used for the correction of the amount of heat.

Specifically, about 2 mg of sample is weighed precisely and is put into a silver pan. Then, the measurement is performed where an empty silver pan is used as a reference. Regarding the measurement, the temperature is raised to 200° C. once and is lowered to 30° C. Thereafter, the temperature is raised again. In this second temperature raising process, the temperature at which the DSC curve exhibits a maximum endothermic peak in the temperature range of 30° C. to 200° C. is taken as the melting point of the wax. In the case where a plurality of peaks are present, the above-described maximum endothermic peak refers to the peak exhibiting a maximum endothermic amount.

Method for Measuring Proportion of Segment Capable of Forming on Crystalline Structure The measurement of the proportion of segment capable of forming on a crystalline structure in the resin (a) is performed by $^1$H-NMR under the following condition.

Measuring apparatus: FT NMR apparatus JNM-EX400 (produced by JEOL LTD.)

Measurement frequency: 400 MHz

Pulse condition: 5.0 μs

Frequency range: 10,500 Hz

The number of integration: 64 times

Measurement temperature: 30° C.

Sample: preparation is performed by putting 50 mg of block polymer to be measured into a sample tube having an inside diameter of 5 mm, adding deuterated chloroform ($CDCl_3$) as a solvent, and dissolving this in a constant temperature bath at 40° C.

On the basis of the resulting $^1$H-NMR chart, among peaks assigned to the constituents of the segment capable of forming on a crystalline structure, a peak independent of peaks assigned to other constituents is selected, and the integral $S_1$ of this peak is calculated. Likewise, among peaks assigned to the constituents of the amorphous segment, a peak independent of peaks assigned to other constituents is selected, and the integral $S_2$ of this peak is calculated.

The proportion of the segment capable of forming on a crystalline structure is determined by using the above-described integral $S_1$ and integral $S_2$ in a manner as described below. In this regard, each of $n_1$ and $n_2$ in the formula represents the number of hydrogen in the constituent, to which the peak noted on a segment basis is assigned.

$$\text{proportion of segment capable of forming on crystalline structure (mol \%)}=\{(S_1/n_1)/((S_1/n_1)+(S_2/n_2))\}\times100$$

Then, the proportion (percent by mole) of the segment capable of forming on the above-described crystalline structure is converted to percent by mass on the basis of the molecular weight of each component.

EXAMPLES

The present invention will be specifically described below with reference to production examples and examples, although the present invention is not limited to them.

Synthesis of Crystalline Polyester 1

The following raw materials were charged into a heat-dried two-necked flask while nitrogen was introduced.

| | |
|---|---|
| Sebacic acid | 136.8 parts by mass |
| 1,4-Butane diol | 63.2 parts by mass |
| Dibutyltin oxide | 0.1 parts by mass |

The inside of a system was substituted with nitrogen by a decompression operation. Thereafter, agitation was performed at 180° C. for 6 hours. Subsequently, the temperature was raised to 230° C. gradually in a vacuum while agitation was continued and was further kept for 2 hours. When a viscous state was reached, air cooling was performed to terminate the reaction and, thereby, Crystalline polyester 1 was synthesized. The properties of Crystalline polyester 1 are shown in Table 1.

Synthesis of Crystalline Polyester 2

Crystalline polyester 2 was synthesized in the same manner as in the synthesis of Crystalline polyester 1 except that charge of raw materials was changed to the following. The properties of Crystalline polyester 2 are shown in Table 1.

| | |
|---|---|
| Sebacic acid | 112.5 parts by mass |
| Adipic acid | 22.0 parts by mass |
| 1,4-Butane diol | 65.5 parts by mass |
| Dibutyltin oxide | 0.1 parts by mass |

Synthesis of Crystalline Polyester 3

Crystalline polyester 3 was synthesized in the same manner as in the synthesis of Crystalline polyester 1 except that charge of raw materials was changed to the following. The properties of Crystalline polyester 3 are shown in Table 1.

| | |
|---|---|
| Octadecanedioic acid | 152.6 parts by mass |
| 1,4-Butane diol | 47.4 parts by mass |
| Dibutyltin oxide | 0.1 parts by mass |

Synthesis of Crystalline Polyester 4

Crystalline polyester 4 was synthesized in the same manner as in the synthesis of Crystalline polyester 1 except that charge of raw materials was changed to the following. The properties of Crystalline polyester 4 are shown in Table 1.

| | |
|---|---|
| Sebacic acid | 76.0 parts by mass |
| Adipic acid | 55.0 parts by mass |
| 1,4-Butane diol | 69.0 parts by mass |
| Dibutyltin oxide | 0.1 parts by mass |

Synthesis of Crystalline Polyester 5

Crystalline polyester 5 was synthesized in the same manner as in the synthesis of Crystalline polyester 1 except that charge of raw materials was changed to the following. The properties of Crystalline polyester 5 are shown in Table 1.

| | |
|---|---|
| Dodecanedioic acid | 112.2 parts by mass |
| 1,10-Decane diol | 87.8 parts by mass |
| Dibutyltin oxide | 0.1 parts by mass |

Synthesis of Crystalline Polyester 6

Crystalline polyester 6 was synthesized in the same manner as in the synthesis of Crystalline polyester 1 except that charge of raw materials was changed to the following. The properties of Crystalline polyester 6 are shown in Table 1.

| | |
|---|---|
| Sebacic acid | 138.0 parts by mass |
| 1,4-Butane diol | 62.0 parts by mass |
| Dibutyltin oxide | 0.1 parts by mass |

TABLE 1

| | | Maximum endothermic peak | | | | | |
|---|---|---|---|---|---|---|---|
| | Alcohol/acid (molar ratio) | Peak temperature (° C.) | Endothermic amount (J/g) | Half-width (° C.) | Mn | Mw | Mw/Mn |
| Crystalline polyester 1 | 1.05 | 66 | 118 | 3.6 | 4,900 | 11,300 | 2.3 |
| Crystalline polyester 2 | 1.04 | 58 | 113 | 3.6 | 5,100 | 11,200 | 2.2 |
| Crystalline polyester 3 | 1.07 | 83 | 113 | 3.4 | 4,900 | 10,800 | 2.2 |
| Crystalline polyester 4 | 1.04 | 50 | 120 | 3.6 | 5,000 | 10,500 | 2.1 |
| Crystalline polyester 5 | 1.07 | 87 | 110 | 3.7 | 5,000 | 10,500 | 2.1 |
| Crystalline polyester 6 | 1.02 | 65 | 120 | 5.1 | 12,200 | 58,600 | 4.8 |

Synthesis of Amorphous Resin 1

The following raw materials were charged into a heat-dried two-necked flask while nitrogen was introduced.

| | |
|---|---|
| Polyoxypropylene(2.2)-2,2-bis(4-hydroxyphenyl)propane | 30.0 parts by mass |
| Polyoxyethylene(2.2)-2,2-bis(4-hydroxyphenyl)propane | 34.0 parts by mass |
| Terephthalic acid | 30.0 parts by mass |
| Fumaric acid | 6.0 parts by mass |
| Dibutyltin oxide | 0.1 parts by mass |

The inside of a system was substituted with nitrogen by a decompression operation. Thereafter, agitation was performed at 215° C. for 5 hours. Subsequently, the temperature was raised to 230° C. gradually in a vacuum while agitation was continued and was further kept for 2 hours. When a viscous state was reached, air cooling was performed to terminate the reaction and, thereby, Amorphous resin 1, which was an amorphous polyester, was synthesized. Regarding Amorphous resin 1 obtained, Mn was 2,200, Mw was 9,800, and the glass transition temperature was 60° C.

Synthesis of Amorphous Resin 2

Amorphous resin 2 was synthesized in the same manner as in the synthesis of Amorphous resin 1 except that charge of raw materials was changed to the following. Regarding Amorphous resin 2, Mn was 7,200, Mw was 43,000, and the glass transition temperature was 63° C.

| | |
|---|---|
| Polyoxypropylene(2.2)-2,2-bis(4-hydroxyphenyl)propane | 30.0 parts by mass |
| Polyoxyethylene(2.2)-2,2-bis(4-hydroxyphenyl)propane | 33.0 parts by mass |
| Terephthalic acid | 21.0 parts by mass |
| Trimellitic anhydride | 1.0 parts by mass |
| Fumaric acid | 3.0 parts by mass |
| Dodecenyl succinic acid | 12.0 parts by mass |
| Dibutyltin oxide | 0.1 parts by mass |

Synthesis of Amorphous Resin 3

The following raw materials were charged into a reaction container provided with an agitator and a thermometer while substitution with nitrogen was performed.

| | |
|---|---|
| Xylylene diisocyanate (XDI) | 117.0 parts by mass |
| Cyclohexane dimethanol (CHDM) | 83.0 parts by mass |
| Acetone | 200.0 parts by mass |

Heating to 50° C. was performed and an urethane-forming reaction was effected over 15 hours. Thereafter, 3.0 parts by mass of tertiary butyl alcohol was added to modify an isocyanate end. Acetone serving as a solvent was removed through distillation, so as to obtain Amorphous resin 3. Regarding the resulting Amorphous resin 3, Mn was 4,400 and Mw was 20,000.

Synthesis of Block Polymer 1

| | |
|---|---|
| Crystalline polyester 1 | 210.0 parts by mass |
| Xylylene diisocyanate (XDI) | 56.0 parts by mass |

-continued

| | |
|---|---|
| Cyclohexane dimethanol (CHDM) | 34.0 parts by mass |
| Tetrahydrofuran (THF) | 300.0 parts by mass |

The above-described raw materials were charged into a reaction container provided with an agitator and a thermometer while substitution with nitrogen was performed. Heating to 50° C. was performed and an urethane-forming reaction was effected over 15 hours. Thereafter, 3.0 parts by mass of tertiary butyl alcohol was added to modify an isocyanate existing on terminal. THF serving as a solvent was removed through distillation, so as to obtain Block polymer 1. The properties of Block polymer 1 obtained are shown in Table 3.

Synthesis of Block Polymers 2 to 14

Block polymers 2 to 14 were synthesized in the same manner as in the synthesis of Block polymer 1 except that the materials used and the amount of blend were changed to the conditions shown in Table 2. The properties of Block polymers 2 to 14 obtained are shown in Table 3.

Synthesis of Block Polymer 15

| | |
|---|---|
| Crystalline polyester 1 | 195.0 parts by mass |
| Amorphous resin 1 | 105.0 parts by mass |
| Dibutyltin oxide | 0.1 parts by mass |

The above-described raw materials were charged into a reaction container provided with an agitator and a thermometer while substitution with nitrogen was performed. Heating to 200° C. was performed and an esterification reaction was effected over 5 hours, so as to obtain Block polymer 15. The properties of Block polymer 15 obtained are shown in Table 3.

TABLE 2

| | | Amount of blend of material (parts by mass) | | | | | |
|---|---|---|---|---|---|---|---|
| Resin (a) | | Crystalline polyester | XDI | CHDM | Amorphous resin 1 | t-BuOH | THF |
| Block polymer 1 | Crystalline polyester 1 | 210.0 | 56.0 | 34.0 | — | 3.0 | 300.0 |
| Block polymer 2 | Crystalline polyester 1 | 156.0 | 86.0 | 58.0 | — | 3.0 | 300.0 |
| Block polymer 3 | Crystalline polyester 1 | 234.0 | 43.0 | 23.0 | — | 3.0 | 300.0 |
| Block polymer 4 | Crystalline polyester 2 | 210.0 | 56.0 | 34.0 | — | 3.0 | 300.0 |
| Block polymer 5 | Crystalline polyester 3 | 210.0 | 56.0 | 34.0 | — | 3.0 | 300.0 |
| Block polymer 6 | Crystalline polyester 1 | 144.0 | 93.0 | 63.0 | — | 3.0 | 300.0 |
| Block polymer 7 | Crystalline polyester 1 | 135.0 | 97.0 | 68.0 | — | 3.0 | 300.0 |
| Block polymer 8 | Crystalline polyester 1 | 258.0 | 30.0 | 12.0 | — | 3.0 | 300.0 |
| Block polymer 9 | Crystalline polyester 1 | 210.0 | 57.0 | 33.0 | — | 3.0 | 300.0 |
| Block polymer 10 | Crystalline polyester 1 | 210.0 | 58.0 | 32.0 | — | 3.0 | 300.0 |
| Block polymer 11 | Crystalline polyester 1 | 210.0 | 55.5 | 34.5 | — | 3.0 | 300.0 |
| Block polymer 12 | Crystalline polyester 1 | 210.0 | 55.0 | 35.0 | — | 3.0 | 300.0 |
| Block polymer 13 | Crystalline polyester 4 | 210.0 | 56.0 | 34.0 | — | 3.0 | 300.0 |
| Block polymer 14 | Crystalline polyester 5 | 210.0 | 56.0 | 34.0 | — | 3.0 | 300.0 |

TABLE 2-continued

| Resin (a) | | Amount of blend of material (parts by mass) | | | | | |
|---|---|---|---|---|---|---|---|
| | | Crystalline polyester | XDI | CHDM | Amorphous resin 1 | t-BuOH | THF |
| Block polymer 15 | Crystalline polyester 1 | 195.0 | — | — | 105.0 | — | — |

XDI: Xylylene diisocyanate
CHDM: Cyclohexane dimethanol
t-BuOH: Tertiary butyl alcohol
THF: Tetrahydrofuran

TABLE 3

| Resin (a) | | Polyester unit content (percent by mass) | Peak temperature (° C.) | Mn | Mw | Mw/Mn |
|---|---|---|---|---|---|---|
| Block polymer 1 | Crystalline polyester 1 | 70 | 58 | 15,900 | 33,700 | 2.1 |
| Block polymer 2 | Crystalline polyester 1 | 52 | 58 | 13,100 | 29,200 | 2.2 |
| Block polymer 3 | Crystalline polyester 1 | 78 | 58 | 14,100 | 30,900 | 2.2 |
| Block polymer 4 | Crystalline polyester 2 | 70 | 50 | 14,400 | 31,000 | 2.2 |
| Block polymer 5 | Crystalline polyester 3 | 70 | 75 | 15,900 | 35,200 | 2.2 |
| Block polymer 6 | Crystalline polyester 1 | 48 | 58 | 10,800 | 23,000 | 2.1 |
| Block polymer 7 | Crystalline polyester 1 | 45 | 58 | 18,500 | 41,600 | 2.2 |
| Block polymer 8 | Crystalline polyester 1 | 86 | 58 | 12,700 | 28,400 | 2.2 |
| Block polymer 9 | Crystalline polyester 1 | 70 | 58 | 9,600 | 19,800 | 2.1 |
| Block polymer 10 | Crystalline polyester 1 | 70 | 58 | 6,900 | 14,900 | 2.2 |
| Block polymer 11 | Crystalline polyester 1 | 70 | 58 | 28,100 | 58,100 | 2.1 |
| Block polymer 12 | Crystalline polyester 1 | 70 | 58 | 39,800 | 73,700 | 1.9 |
| Block polymer 13 | Crystalline polyester 4 | 70 | 42 | 15,300 | 34,500 | 2.3 |
| Block polymer 14 | Crystalline polyester 5 | 70 | 79 | 15,100 | 33,000 | 2.2 |
| Block polymer 15 | Crystalline polyester 1 | 100 | 58 | 19,800 | 75,200 | 3.8 |

Preparation of Block Polymer Resin Solution 1

Block polymer resin solution 1 was prepared by putting 500.0 parts by mass of acetone and 500.0 parts by mass of Block polymer 1 into a beaker provided with an agitator and continuing agitation at a temperature of 40° C. until dissolution was completed.

Preparation of Block Polymer Resin Solutions 2 to 15

Block polymer resin solutions 2 to 15 were prepared in the same manner as in preparation of Block polymer resin solution 1 except that Block polymer 1 was changed to Block polymers 2 to 15.

Preparation of Crystalline Polyester Resin Solution 1

Crystalline polyester resin solution 1 was prepared by putting 500.0 parts by mass of tetrahydrofuran (THF) and 500.0 parts by mass of Crystalline polyester 6 into a beaker provided with an agitator and continuing agitation at a temperature of 40° C. until dissolution was completed.

Preparation of Amorphous Resin Solution 1

Amorphous resin solution 1 was prepared by putting 500.0 parts by mass of acetone and 500.0 parts by mass of Amorphous resin 3 into a beaker provided with an agitator and continuing agitation at a temperature of 40° C. until dissolution was completed.

Preparation of Resin Fine Particle Dispersion Liquid 1

A two-necked flask provided with a dripping funnel was heat-dried and 870.0 parts by mass of normal hexane was charged therein.

A monomer solution was prepared by charging 42.0 parts by mass of normal hexane, 52.0 parts by mass of behenyl acrylate (acrylate of alcohol including a straight-chain alkyl group having the carbon number of 22), and 0.3 parts by mass of azobismethoxydimethylvaleronitrile into another beaker and performing agitation and mixing at 20° C. and was introduced into the dripping funnel.

After the reaction container was subjected to substitution with nitrogen, the monomer solution was dropped at 40° C. over 1 hour under an enclosed state. Agitation was continued for 3 hours after completion of dropping, a mixture of 0.3 parts by mass of azobismethoxydimethylvaleronitrile and 42.0 parts by mass of normal hexane was dropped again, and agitation was performed at 40° C. for 3 hours.

Subsequently, cooling to room temperature was performed, so that Resin fine particle dispersion liquid 1 having a number average particle diameter of 200 nm and a solid content of 20 percent by mass was obtained.

Preparation of Crystalline Polyester Dispersion Liquid 1

| | |
|---|---|
| Crystalline polyester 6 | 115.0 parts by mass |
| Ionic surfactant Neogen RK (produced by Dai-ichi Kogyo Seiyaku Co., Ltd.) | 5.0 parts by mass |
| Ion-exchanged water | 180.0 parts by mass |

The above-described individual components were mixed and heated to 100° C., dispersion was performed sufficiently with Ultra-Turrax T50 produced by IKA, and a dispersion treatment was performed for 1 hour with a pressure discharge type Gaulin Homogenizer, so that Crystalline polyester dispersion liquid 1 having a number average particle diameter of 200 nm and a solid content of 40 percent by mass was obtained.

Preparation of Amorphous Resin Dispersion Liquids 1 to 3

Amorphous resin dispersion liquids 1 to 3 were prepared in the same manner as in preparation of Crystalline polyester dispersion liquid 1 except that Crystalline polyester 6 was changed to Amorphous resin dispersion liquids 1 to 3.

Preparation of Colorant Dispersion Liquid 1

| | |
|---|---|
| C.I. Pigment Blue 15:3 | 100.0 parts by mass |
| Acetone | 150.0 parts by mass |
| Glass beads (1 mm) | 300.0 parts by mass |

The above-described materials were put into a heat-resistant glass container, dispersion was performed for 5 hours with Paint Shaker (produced by Toyo Seiki Seisaku-sho, Ltd.), and the glass beads were removed with a nylon mesh, so that Colorant dispersion liquid 1 was obtained.

Preparation of Colorant Dispersion Liquid 2

| | |
|---|---|
| C.I. Pigment Blue 15:3 | 45.0 parts by mass |
| Ionic surfactant Neogen RK (produced by Dai-ichi Kogyo Seiyaku Co., Ltd.) | 5.0 parts by mass |
| Ion-exchanged water | 200.0 parts by mass |

The above-described materials were put into a heat-resistant glass container, dispersion was performed for 5 hours with Paint Shaker (produced by Toyo Seiki Seisaku-sho, Ltd.), and the glass beads were removed with a nylon mesh, so that Colorant dispersion liquid 2 was obtained.

Preparation of Wax Dispersion Liquid 1

| | |
|---|---|
| Carnauba wax (melting point 81° C.) | 16.0 parts by mass |
| Nitrile-containing styrene acrylic resin (monomer mass ratio: styrene/n-butyl acrylate/acrylonitrile = 65.0/35.0/10.0, peak molecular weight 8,500) | 8.0 parts by mass |
| Acetone | 76.0 parts by mass |

The above-described materials were put into a glass beaker with an agitation blade (produced by Iwaki Glass Co., Ltd.), and the inside of the system was heated to 70° C., so that the carnauba wax was dissolved into acetone.

The inside of the system was cooled while being agitated gently at 50 rpm and, thereby, was cooled to 25° C. over 3 hours, so that a milk-white liquid was obtained.

The resulting solution was put into a heat-resistant container together with 20.0 parts by mass of 1 mm glass beads, and dispersion was performed for 3 hours with Paint Shaker, so that Wax dispersion liquid 1 was obtained.

The particle diameter of the wax in Wax dispersion liquid 1 described above was measured with Microtrac particle size distribution measuring apparatus HRA (X-100) (produced by NIKKISO CO., LTD.) and was 200 nm on a number average particle diameter basis.

Preparation of Wax Dispersion Liquid 2

| | |
|---|---|
| Paraffin wax (HNP-10; produced by NIPPON SEIRO CO., LTD., melting point 75° C.): | 45.0 parts by mass |
| Cationic surfactant Neogen RK (produced by Dai-ichi Kogyo Seiyaku Co., Ltd.) | 5.0 parts by mass |
| Ion-exchanged water | 200.0 parts by mass |

The above-described materials were mixed and heated to 95° C., dispersion was performed sufficiently with Ultra-Turrax T50 produced by IKA, and a dispersion treatment was performed with a pressure discharge type Gaulin Homogenizer, so that Wax dispersion liquid 2 having a number average particle diameter of 200 nm and a solid content of 25 percent by mass was obtained.

Example 1

Production of Toner Particles (Before Treatment)

Regarding an experimental apparatus shown in FIG. 1, valves V1, V2, and a pressure control valve V3 were closed, Resin fine particle dispersion liquid 1 was charged into a pressure-resistant granulation tank T1 provided with a filter to capture toner particles and an agitation mechanism, and the internal temperature was adjusted to 30° C. The valve V1 was opened, carbon dioxide (purity 99.990) was introduced into the pressure-resistant granulation tank T1 from a bomb B1 by using a pump P1, and the valve V1 was closed when the internal pressure reached 5 MPa.

Meanwhile, Block polymer resin solution 1, Wax dispersion liquid 1, Colorant dispersion liquid 1, and acetone were charged into a resin solution tank T2, and the internal temperature was adjusted to 30° C.

Valve V2 was opened, the content in the resin solution tank T2 was introduced into the granulation tank T1 by using a pump 2 while the inside of the granulation tank T1 was agitated at 2,000 rpm. After the whole content was introduced, the valve 2 was closed.

After the introduction, the internal pressure of the granulation tank T1 reached 8 MPa.

In this regard, the amount of charge (mass ratio) of various materials are as described below.

| | |
|---|---|
| Block polymer resin solution 1 | 160.0 parts by mass |
| Wax dispersion liquid 1 | 62.5 parts by mass |
| Colorant dispersion liquid 1 | 12.5 parts by mass |
| Acetone | 35.0 parts by mass |
| Resin fine particle dispersion liquid 1 | 37.5 parts by mass |
| Carbon dioxide | 320.0 parts by mass |

The mass of introduced carbon dioxide was calculated by calculating the density of carbon dioxide from the temperature (30° C.) and the pressure (8 MPa) of carbon dioxide on the basis of the equation of state described in the document (Journal of Physical and Chemical Reference data, vol. 25, P. 1509-1596), and multiplying the density by the volume of the granulation tank T1.

After introduction of the content in the resin solution tank T2 into the granulation tank T1 was completed, agitation was further performed at 2,000 rpm for 3 minutes so as to effect granulation.

The valve V1 was opened, and carbon dioxide was introduced into the granulation tank T1 from the bomb B1 by using the pump P1. At this time, carbon dioxide was further passed while the pressure control valve V3 was set at 10 MPa and, thereby, the internal pressure of the granulation tank T1 was kept at 10 MPa. By this operation, carbon dioxide containing the organic solvent (mainly acetone) extracted from liquid droplets after granulation was discharged to a solvent recovery tank T3, so that the organic solvent and the carbon dioxide were separated.

The introduction of carbon dioxide into the granulation tank T1 was stopped when the amount five times the amount of mass of carbon dioxide initially introduced into the granulation tank T1 was reached. At this point in time, the operation to substitute carbon dioxide containing the organic solvent with carbon dioxide not containing the organic solvent was completed.

Furthermore, the pressure control valve V3 was opened little by little, the internal pressure of the granulation tank T1 was decompressed to atmospheric pressure and, thereby, Toner particles (before treatment) 1 captured by the filter were recovered. The DSC measurement of the resulting Toner particles (before treatment) 1 was performed so that the peak temperature of the maximum endothermic peak was determined and was 58° C.

Annealing Treatment

An annealing treatment was performed by using a constant temperature dryer (41-S5 produced by Satake Chemical Equipment Mfg Ltd.). The internal temperature of the constant temperature dryer was adjusted to 51° C.

Toner particles (before treatment) 1 described above were spread in a stainless steel vat uniformly. This was put into the above-described constant temperature dryer, so as to be stood for 12 hours and, thereafter, was taken out. In this manner, Toner particles (after treatment) 1 subjected to the annealing treatment were obtained.

Preparation of Toner (External Addition Treatment)

Toner 1 according to the present invention was obtained by dry-mixing 100.0 parts by mass of Toner particles (after treatment) 1 described above with 1.8 parts by mass of hydrophobic silica fine powder treated with hexamethylsilazane (number average primary particle diameter: 7 nm) and 0.15 parts by mass of rutile type titanium oxide fine powder (number average primary particle diameter: 30 nm) with Henschel mixer (produced by MITSUI MINING COMPANY, LIMITED) for 5 minutes. The properties of Toner 1 are shown in Table 4. The results of the following evaluation are shown in Table 5.

Evaluation Method

Thermal Storage Resistance

About 10 g of Toner 1 was put into a 100 ml plastic cup and was stood for 3 days in a constant temperature bath adjusted to 50° C. Thereafter, visual evaluation was performed. The same evaluation was performed by using a constant temperature bath adjusted to 55° C. The evaluation criteria of the thermal storage resistance are as described below.

A: Aggregates are not observed and the state is nearly the same as the initial state.

B: Aggregates are observed slightly, but are in the state of being loosened by shaking the plastic cup 5 times gently.

C: Aggregates tend to be observed, but are in the state of being loosened with fingers.

D: Aggregates are observed to a large extent.

E: Solidification not suitable for use is observed.

Low-Temperature Fixability

A commercially available printer LBP 5300 produced by CANON KABUSHIKI KAISHA was used, and the low-temperature fixability was evaluated.

Regarding LBP 5300, one-component contact development was adopted, and the amount of the toner on a development bearing member was regulated by a toner regulation member. Regarding a cartridge for the evaluation, the toner in a commercially available cartridge was taken out, the inside was cleaned by air blowing, and Toner 1 described above was filled therein, and the resulting cartridge was used. The above-described cartridge was mounted on the cyan station and dummy cartridges were mounted on the other stations. Then, an unfixed toner image (the amount of loading of toner per unit area 0.6 mg/cm$^2$) was formed on the normal paper for copier (81.4 g/m$^2$) and the cardboard (157 g/m$^2$).

The fixing device of the commercially available printer LBP 5900 produced by CANON KABUSHIKI KAISHA was modified in such a way that the fixing temperature was able to be set manually, the rotation speed of the fixing device was changed to 270 mm/s, and the pressure in the nip was changed to 120 kPa. This modified fixing device was used, the fixing temperature was raised by 5° C. in a range of 80° C. to 150° C. in an environment of ambient temperature and room humidity (23° C., 600), and a fixed image of the above-described unfixed image was obtained at each temperature.

The image region of the resulting fixed image was covered with soft thin paper (for example, trade name "Dusper", produced by OZU CORPORATION), and rubbing was performed 5 times in a reciprocating manner while a load of 4.9 kPa was applied to the above-described thin paper.

Each of the image densities before and after the rubbing was measured, the factor of reduction in image density ΔD (%) was calculated on the basis of the following formula. The temperature at which the resulting AD (%) became 100 or less was specified to be a fixing start temperature serving as an evaluation indicator of the low-temperature fixability.

$$\Delta D(\%)=\{(\text{image density before rubbing}-\text{image density after rubbing})/\text{image density before rubbing}\}\times 100$$

The image density was measured with a color reflection densitometer (Color reflection densitometer X-Rite 404A: produced by X-Rite).

Image Density

Regarding Toner 1, the image density was evaluated in a manner as described below. Two types of toners, that is, the toner after being stood at ambient temperature and room humidity (23° C., 600) for 24 hours and the toner after being stored in a severe environment of 40° C. and 95% RH for 50 days, were employed as toners for evaluation.

The above-described evaluation unit and the above-described cartridge were used, an image after fixing was formed in an environment of ambient temperature and room humidity (23° C., 600) on color laser copier paper produced by CANON KABUSHIKI KAISHA while the amount of loading of toner was adjusted to become 0.35 mg/cm$^2$ on a solid image basis.

The density of the resulting image was evaluated by using a reflection densitometer (500 Series Spectrodensitometer) produced by X-Rite.

Examples 2 and 3

Production of Toner Particles (Before Treatment)

Toner particles (before treatment) 2 and 3 were obtained in the same manner as in Example 1 except that Block polymer resin solution 2 or 3 was used in place of Block polymer resin solution 1 in the toner particles (before treatment) production step in Example 1. The DSC measurement of the resulting Toner particles (before treatment) 2 and 3 was performed, so that each peak temperature of the maximum endothermic peak was determined and was 58° C.

Toner particles (before treatment) 2 and 3 were subjected to the annealing treatment and the external addition treatment in the same manner as in Example 1, so as to obtain Toners 2 and 3 according to the present invention.

Example 4

Production of Toner Particles (Before Treatment)

Toner particles (before treatment) 4 were obtained in the same manner as in Example 1 except that Block polymer resin solution 1 in the toner particles (before treatment) production step in Example 1 was changed to Block polymer resin solution 4. The peak temperature of the maximum endothermic peak in the DSC measurement of the resulting Toner particles (before treatment) 4 was 50° C.

Toner particles (before treatment) 4 were subjected to the annealing treatment and the external addition treatment in the same manner as in Example 1 except that the annealing temperature was changed to 43° C., so as to obtain Toner 4 according to the present invention.

Example 5

Production of Toner Particles (Before Treatment)

Toner particles (before treatment) 5 were obtained in the same manner as in Example 1 except that Block polymer resin solution 1 in the toner particles (before treatment) production step in Example 1 was changed to Block polymer resin solution 5. The peak temperature of the maximum endothermic peak in the DSC measurement of the resulting Toner particles (before treatment) 5 was 75° C.

Toner particles (before treatment) 5 were subjected to the annealing treatment and the external addition treatment in the same manner as in Example 1 except that the annealing temperature was changed to 68° C., so as to obtain Toner 5 according to the present invention.

Example 6

Toner 6 according to the present invention was obtained in the same manner as in Example 1 except that the annealing temperature of 51° C. in the annealing treatment step in Example 1 was changed to 53° C.

Example 7

Toner 7 according to the present invention was obtained in the same manner as in Example 2 except that the annealing temperature of 51° C. in the annealing treatment step in Example 2 was changed to 53° C.

Example 8

Toner 8 according to the present invention was obtained in the same manner as in Example 1 except that the annealing time of 12 hours in the annealing treatment step in Example 1 was changed to 2 hours.

Example 9

Toner 9 according to the present invention was obtained in the same manner as in Example 3 except that the annealing time of 12 hours in the annealing treatment step in Example 3 was changed to 2 hours.

Examples 10 to 16

Production of Toner Particles (Before Treatment)

Toner particles (before treatment) 10 to 16 were obtained in the same manner as in Example 1 except that Block polymer resin solutions 6 to 12 were used in place of Block polymer resin solution 1 in the toner particles (before treatment) production step in Example 1. The peak temperature of the maximum endothermic peak in the DSC measurement of each of the resulting Toner particles (before treatment) 10 to 16 was 58° C.

Toner particles (before treatment) 10 to 16 were subjected to the annealing treatment and the external addition treatment in the same manner as in Example 1, so as to obtain Toners 10 to 16 according to the present invention.

Example 17

Production of Toner Particles (Before Treatment)

Toner particles (before treatment) 17 were obtained in the same manner as in Example 1 except that Block polymer resin solution 1 in the toner particles (before treatment) production step in Example 1 was changed to Block polymer resin solution 15. The peak temperature of the maximum endothermic peak in the DSC measurement of the resulting Toner particles (before treatment) 17 was 58° C.

Toner particles (before treatment) 17 were subjected to the annealing treatment and the external addition treatment in the same manner as in Example 1, so as to obtain Toner 17 according to the present invention.

Example 18

Production of Toner Particles (Before Treatment)

Toner particles (before treatment) 18 were obtained in the same manner as in Example 1 except that the amounts of charge (mass ratio) of various materials in the toner particles (before treatment) production step in Example 1 were changed to the following. The peak temperature of the maximum endothermic peak in the DSC measurement of the resulting Toner particles (before treatment) 18 was 57° C.

| | |
|---|---|
| Crystalline polyester resin solution 1 | 112.0 parts by mass |
| Amorphous resin solution 1 | 48.0 parts by mass |
| Wax dispersion liquid 1 | 62.5 parts by mass |

-continued

| | |
|---|---|
| Colorant dispersion liquid 1 | 12.5 parts by mass |
| Acetone | 35.0 parts by mass |
| Resin fine particle dispersion liquid 1 | 37.5 parts by mass |
| Carbon dioxide | 320.0 parts by mass |

Toner 18 according to the present invention was obtained in the same manner as in Example 1 except that Toner particles (before treatment) 18 was used and the annealing temperature in the annealing treatment step was changed to 50° C.

Comparative Example 1

Production of Toner Particles (Before Treatment)

| | |
|---|---|
| Amorphous resin dispersion solution 1 | 140.0 parts by mass |
| Amorphous resin dispersion solution 2 | 35.0 parts by mass |
| Colorant dispersion liquid 2 | 27.8 parts by mass |
| Wax dispersion liquid 2 | 138.9 parts by mass |
| Polyaluminum chloride | 0.41 parts by mass |

The above-described individual components were charged into a round stainless steel flask, mixing and dispersion were performed sufficiently with Ultra-Turrax T50. Subsequently, 0.36 parts by mass of polyaluminum chloride was added thereto, and a dispersion operation with Ultra-Turrax T50 was continued. The flask was heated to 47° C. in a heating oil bath while agitation was performed and was kept at this temperature for 60 minutes. Thereafter, 37.5 parts by mass of Resin fine particle dispersion liquid 1 was added gradually. Then, the pH in the system was adjusted to 5.4 with 0.5 mol/L sodium hydroxide aqueous solution, the stainless steel flask was sealed, and heating to 96° C. was performed while agitation was continued by using magnetic seal, followed by keeping for 5 hours.

After the reaction was completed, cooling, filtration, sufficient washing with ion-exchanged water were performed. Subsequently, solid liquid separation was performed through Nutsche suction filtration. Filtrated particles were further redispersed into 3 L of ion-exchanged water at 40° C., and agitation and washing were performed at 300 rpm for 15 minutes. This was further repeated 5 times. When the pH of the filtrate became 7.0, solid liquid separation was performed through Nutsche suction filtration by using No. 5A filter paper. Then, vacuum drying was continued for 12 hours, so as to obtain Toner particles (before treatment) 19.

Preparation of Toner

Toner particles (before treatment) 19 described above were subjected to an external addition treatment in a manner similar to that in the toner preparation step in Example 1 without performing an annealing treatment, so as to obtain Toner 19 for comparison.

Comparative Example 2

Toner 20 for comparison was obtained in the same manner as in Comparative example 1 except that the amounts of charge (mass ratio) of various materials in the toner particles (before treatment) production step in Comparative example 1 were changed to the following.

| | |
|---|---|
| Crystalline polyester dispersion liquid 1 | 148.8 parts by mass |
| Amorphous resin dispersion liquid 3 | 63.7 parts by mass |
| Colorant dispersion liquid 2 | 27.8 parts by mass |
| Wax dispersion liquid 2+ | 55.6 parts by mass |
| Polyaluminum chloride | 0.41 parts by mass |

Comparative Example 3

Toner 21 for comparison was obtained in the same manner as in Example 1 except that the toner particles (before treatment) were not subjected to an annealing treatment in Example 1.

Comparative Example 4

Toner 22 for comparison was obtained in the same manner as in Example 3 except that the toner particles (before treatment) were not subjected to an annealing treatment in Example 3.

Reference Example 1

Production of Toner Particles (Before Treatment)

Toner particles (before treatment) 23 were obtained in the same manner as in Example 1 except that Block polymer resin solution 1 in the toner particles (before treatment) production step in Example 1 was changed to Block polymer resin solution 13. The peak temperature of the maximum endothermic peak in the DSC measurement of the resulting Toner particles (before treatment) 23 was 42° C.

Toner 23 was obtained in the same manner as in Example 1 except that Toner particles (before treatment) 23 described above were used and the annealing temperature in the annealing treatment step was changed to 35° C.

Reference Example 2

Production of Toner Particles (Before Treatment)

Toner particles (before treatment) 24 were obtained in the same manner as in Example 1 except that Block polymer resin solution 1 in the toner particles (before treatment) production step in Example 1 was changed to Block polymer resin solution 14. The peak temperature of the maximum endothermic peak in the DSC measurement of the resulting Toner particles (before treatment) 24 was 79° C.

Toner 24 was obtained in the same manner as in Example 1 except that Toner particles (before treatment) 24 described above were used and the annealing temperature in the annealing treatment step was changed to 72° C.

Reference Example 3

Toner 25 for comparison was obtained in the same manner as in Example 1 except that the annealing temperature of 51° C. in the annealing treatment step in Example 1 was changed to 43° C. and the annealing time of 12 hours was changed to 2 hours.

Reference Example 4

Toner 26 for comparison was obtained in the same manner as in Example 3 except that the annealing temperature of 51° C. in the annealing treatment step in Example 3 was changed to 43° C. and the annealing time of 12 hours was changed to 2 hours.

Reference Example 5

Toner 27 for comparison was obtained in the same manner as in Example 1 except that the annealing temperature of 51° C. in the annealing treatment step in Example 1 was changed to 56° C.

Reference Example 6

Toner 28 for comparison was obtained in the same manner as in Example 2 except that the annealing temperature of 51° C. in the annealing treatment step in Example 2 was changed to 56° C.

The properties of each toner obtained are shown in Table 4. The same evaluation as in Example 1 was performed and the results are shown in Table 5.

Regarding toners according to Example 5 and Reference example 2, the maximum endothermic peak of the curve of the endothermic amount of the toner overlapped the endothermic peak of the wax. Therefore, each value was determined on the assumption that the endothermic peak derived from the binder resin was determined by subtracting the endothermic amount of the wax from the maximum endothermic peak. In examples other than them, each value was determined where the maximum endothermic peak of the curve of the endothermic amount of the toner was as-is considered to be the endothermic peak derived from the binder resin.

TABLE 4

| | | Resin (a) | T10 (° C.) | W10 (° C.) | Formula (1) | Formula (2) | Endothermic amount per gram of binder resin (J/g) | Crystalline unit content (percent by mass) | D4 (μm) | D4/D1 | Mn | Mw | Mw/Mn |
|---|---|---|---|---|---|---|---|---|---|---|---|---|---|
| Example 1 | Toner 1 | Block polymer 1 | 61 | 2.6 | 0.62 | 1.31 | 43 | 70 | 5.5 | 1.15 | 15,700 | 33,600 | 2.1 |
| Example 2 | Toner 2 | Block polymer 2 | 61 | 2.4 | 0.58 | 1.33 | 34 | 52 | 5.5 | 1.15 | 12,900 | 29,100 | 2.3 |
| Example 3 | Toner 3 | Block polymer 3 | 61 | 2.8 | 0.61 | 1.29 | 62 | 78 | 5.7 | 1.17 | 13,900 | 30,800 | 2.2 |
| Example 4 | Toner 4 | Block polymer 4 | 53 | 2.6 | 0.62 | 1.31 | 43 | 70 | 5.4 | 1.14 | 14,200 | 30,900 | 2.2 |
| Example 5 | Toner 5 | Block polymer 5 | 78 | 2.6 | 0.62 | 1.31 | 43 | 70 | 5.5 | 1.15 | 15,700 | 35,100 | 2.2 |
| Example 6 | Toner 6 | Block polymer 1 | 62 | 2.4 | 0.46 | 1.33 | 40 | 70 | 5.5 | 1.15 | 15,600 | 33,500 | 2.1 |
| Example 7 | Toner 7 | Block polymer 2 | 62 | 2.1 | 0.24 | 1.38 | 32 | 52 | 5.5 | 1.15 | 13,000 | 29,200 | 2.2 |
| Example 8 | Toner 8 | Block polymer 1 | 60 | 3.0 | 0.77 | 1.27 | 46 | 70 | 5.5 | 1.15 | 15,800 | 33,700 | 2.1 |
| Example 9 | Toner 9 | Block polymer 3 | 60 | 3.4 | 0.94 | 1.26 | 65 | 78 | 5.6 | 1.18 | 13,800 | 30,800 | 2.2 |
| Example 10 | Toner 10 | Block polymer 6 | 61 | 2.3 | 0.61 | 1.35 | 32 | 48 | 5.5 | 1.15 | 10,600 | 22,900 | 2.2 |
| Example 11 | Toner 11 | Block polymer 7 | 61 | 2.2 | 0.59 | 1.36 | 28 | 45 | 5.5 | 1.15 | 18,300 | 41,500 | 2.3 |
| Example 12 | Toner 12 | Block polymer 8 | 61 | 3.0 | 0.57 | 1.27 | 85 | 86 | 5.8 | 1.17 | 12,500 | 28,300 | 2.3 |
| Example 13 | Toner 13 | Block polymer 9 | 61 | 2.6 | 0.62 | 1.31 | 43 | 70 | 5.5 | 1.15 | 9,400 | 19,700 | 2.1 |
| Example 14 | Toner 14 | Block polymer 10 | 61 | 2.6 | 0.62 | 1.31 | 43 | 70 | 5.5 | 1.15 | 6,700 | 14,800 | 2.2 |
| Example 15 | Toner 15 | Block polymer 11 | 61 | 3.0 | 0.60 | 1.33 | 43 | 70 | 5.6 | 1.16 | 27,900 | 58,000 | 2.1 |
| Example 16 | Toner 16 | Block polymer 12 | 61 | 3.2 | 0.63 | 1.31 | 43 | 70 | 5.9 | 1.21 | 39,600 | 73,600 | 1.9 |
| Example 17 | Toner 17 | Block polymer 15 | 61 | 2.8 | 0.71 | 1.29 | 40 | 65 | 5.5 | 1.15 | 19,600 | 75,100 | 3.8 |
| Example 18 | Toner 18 | Crystalline polyester 6 Amorphous resin 3 | 60 | 3.3 | 0.64 | 1.36 | 57 | 70 | 5.9 | 1.21 | 12,000 | 58,500 | 4.9 |
| Comparative example 1 | Toner 19 | Amorphous resin 1 Amorphous resin 2 | (72) | (2.6) | (0.38) | (1.65) | (45) | 0 | 6.0 | 1.19 | 7,000 | 42,900 | 6.1 |
| Comparative example 2 | Toner 20 | Crystalline polyester 6 Amorphous resin 3 | 55 | 5.8 | 1.64 | 1.21 | 62 | 70 | 6.2 | 1.16 | 12,100 | 58,800 | 4.9 |
| Comparative example 3 | Toner 21 | Block polymer 1 | 58 | 4.3 | 1.21 | 1.14 | 52 | 70 | 5.8 | 1.15 | 15,700 | 33,500 | 2.1 |
| Comparative example 4 | Toner 22 | Block polymer 3 | 58 | 5.4 | 1.65 | 1.11 | 75 | 78 | 5.4 | 1.13 | 14,000 | 30,900 | 2.2 |
| Reference example 1 | Toner 23 | Block polymer 13 | 45 | 2.6 | 0.62 | 1.31 | 43 | 70 | 5.6 | 1.16 | 15,100 | 34,400 | 2.3 |
| Reference example 2 | Toner 24 | Block polymer 14 | 82 | 2.6 | 0.62 | 1.31 | 43 | 70 | 5.6 | 1.16 | 14,900 | 32,900 | 2.2 |
| Reference example 3 | Toner 25 | Block polymer 1 | 59 | 3.4 | 1.06 | 1.21 | 48 | 70 | 5.4 | 1.13 | 15,800 | 33,600 | 2.1 |
| Reference example 4 | Toner 26 | Block polymer 3 | 59 | 4.2 | 1.36 | 1.19 | 68 | 78 | 5.5 | 1.15 | 13,800 | 30,600 | 2.2 |
| Reference example 5 | Toner 27 | Block polymer 1 | 64 | 2.1 | 0.24 | 1.38 | 37 | 70 | 5.8 | 1.18 | 15,600 | 33,700 | 2.2 |

TABLE 4-continued

| | | Resin (a) | T10 (° C.) | W10 (° C.) | Formula (1) | Formula (2) | Endothermic amount per gram of binder resin (J/g) | Crystalline unit content (percent by mass) | D4 (μm) | D4/D1 | Mn | Mw | Mw/Mn |
|---|---|---|---|---|---|---|---|---|---|---|---|---|---|
| Reference example 6 | Toner 28 | Block polymer 2 | 64 | 1.9 | 0.16 | 1.42 | 27 | 52 | 5.0 | 1.14 | 12,800 | 29,000 | 2.3 |

Formula (1): W1/W10,
Formula (2): W20/W10
Maximum endothermic peak in Comparative example 1 is derived from wax. The value in Table is a profile of a peak derived from wax.

TABLE 5

| | Thermal storage resistance | | Low-temperature fixability | | Image density | |
|---|---|---|---|---|---|---|
| | 50° C. | 55° C. | Normal paper | Cardboard | Ambient temperature and room humidity | Severe environment after 50 days |
| Example 1 | A | A | 100 | 100 | 1.55 | 1.53 |
| Example 2 | A | A | 105 | 110 | 1.55 | 1.53 |
| Example 3 | A | A | 100 | 100 | 1.48 | 1.46 |
| Example 4 | B | C | 95 | 100 | 1.55 | 1.50 |
| Example 5 | A | A | 110 | 120 | 1.55 | 1.53 |
| Example 6 | A | B | 100 | 100 | 1.52 | 1.49 |
| Example 7 | A | B | 105 | 110 | 1.51 | 1.48 |
| Example 8 | A | B | 100 | 100 | 1.51 | 1.46 |
| Example 9 | A | B | 100 | 100 | 1.47 | 1.42 |
| Example 10 | A | B | 110 | 115 | 1.55 | 1.52 |
| Example 11 | A | B | 115 | 120 | 1.55 | 1.51 |
| Example 12 | A | A | 100 | 100 | 1.44 | 1.40 |
| Example 13 | B | B | 100 | 100 | 1.55 | 1.51 |
| Example 14 | B | C | 95 | 100 | 1.53 | 1.47 |
| Example 15 | A | A | 110 | 115 | 1.54 | 1.52 |
| Example 16 | A | A | 110 | 120 | 1.55 | 1.53 |
| Example 17 | A | B | 105 | 115 | 1.53 | 1.48 |
| Example 18 | A | B | 100 | 105 | 1.45 | 1.40 |
| Comparative example 1 | C | E | 120 | 130 | 1.49 | 1.41 |
| Comparative example 2 | C | E | 110 | 120 | 1.42 | 1.34 |
| Comparative example 3 | C | D | 100 | 105 | 1.51 | 1.43 |
| Comparative example 4 | C | D | 100 | 110 | 1.45 | 1.37 |
| Reference example 1 | D | E | 95 | 95 | 1.55 | 1.50 |
| Reference example 2 | A | A | 120 | 130 | 1.54 | 1.52 |
| Reference example 3 | B | D | 100 | 105 | 1.50 | 1.43 |
| Reference example 4 | B | D | 100 | 110 | 1.49 | 1.42 |
| Reference example 5 | B | D | 100 | 100 | 1.51 | 1.44 |
| Reference example 6 | B | D | 105 | 110 | 1.50 | 1.43 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-165306 filed Jul. 22, 2010, which is hereby incorporated by reference herein in its entirety.

What is claimed is:

1. A toner comprising toner particles each of which comprises a binder resin, a colorant and wax, wherein the binder resin comprises a resin (a) having 50 percent by mass or more of polyester unit, and wherein, in the measurement of the endothermic amount of the toner by using a differential scanning calorimeter, (1) regarding the endothermic amount derived from the binder resin in the measurement at a temperature raising rate of 10.0° C./min, the peak temperature (T10) of a maximum endothermic peak (P10) is 50° C. or higher and 80° C. or lower, and the half-width (W10) of the maximum endothermic peak (P10) is 2.0° C. or more and 3.5° C. or less, and (2) W1, W10, and W20 satisfy the following formulae (1) and (2), $$0.20 \leq (W1/W10) \leq 1.00 \quad (1)$$

$$1.00 \leq (W20/W10) \leq 1.50 \quad (2)$$

where W1 (° C.) represents the half-width of a maximum endothermic peak (P1) regarding the endothermic amount derived from the binder resin in the measurement at a temperature raising rate of 1.0° C./min, and W20 (° C.) represents the half-width of a maximum endothermic peak (P20) regarding the endothermic amount derived from the binder resin in the measurement at a temperature raising rate of 20.0° C./min, wherein the resin (a) is a block polymer of a resin component (a1) capable of forming a crystalline structure, and a resin component (a2) not forming a crystalline structure that is bonded to the resin component (a1), and wherein the resin (a) comprises 50 percent by mass or more of resin component (a1) capable of forming a crystalline structure.

2. The toner according to claim 1, wherein the endothermic amount per gram of the binder resin determined from the maximum endothermic peak (P10) is 30 J/g or more, and 80 J/g or less.

3. The toner according to claim 1, wherein, in gel permeation chromatography (GPC) measurement of tetrahydrofuran (THF)-soluble matter of the toner, the number average molecular weight (Mn) is 8,000 or more, and 30,000 or less and the weight average molecular weight (Mw) is 15,000 or more, and 60,000 or less.

4. The toner according to claim 1, wherein the block polymer is a block polymer, in which the resin component (a1) and the resin component (a2) are bonded by an urethane bond.

* * * * *